US011741892B2

(12) United States Patent
Yang et al.

(10) Patent No.: US 11,741,892 B2
(45) Date of Patent: Aug. 29, 2023

(54) PIXEL CIRCUIT INCLUDING A LEAKAGE SUPPRESSION MODULE TO IMPROVE DISPLAY STABILITY

(71) Applicants: Wuhan Tianma Micro-Electronics Co., Ltd., Wuhan (CN); Wuhan Tianma Microelectronics Co., Ltd. Shanghai Branch, Shanghai (CN)

(72) Inventors: Shuai Yang, Shanghai (CN); Yue Li, Shanghai (CN); Mengmeng Zhang, Shanghai (CN); Gaojun Huang, Shanghai (CN)

(73) Assignees: WUHAN TIANMA MICRO-ELECTRONICS CO., LTD., Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 0 days.

(21) Appl. No.: 17/454,856

(22) Filed: Nov. 15, 2021

(65) Prior Publication Data

US 2023/0059117 A1 Feb. 23, 2023

(30) Foreign Application Priority Data

Aug. 20, 2021 (CN) ..... 202110960998.X

(51) Int. Cl.
*G09G 3/3208* (2016.01)

(52) U.S. Cl.
CPC ... *G09G 3/3208* (2013.01); *G09G 2300/0842* (2013.01); *G09G 2310/0297* (2013.01);
(Continued)

(58) Field of Classification Search
None
See application file for complete search history.

(56) References Cited

U.S. PATENT DOCUMENTS 11,361,713 B1 * 6/2022 Fu ..... G09G 3/3233
2011/0227908 A1 * 9/2011 Choi ..... G09G 3/3233 345/215

(Continued)

FOREIGN PATENT DOCUMENTS

CN 111243501 A 6/2020
CN 111354307 A 6/2020
CN 112397025 A 2/2021

*Primary Examiner* — Benjamin C Lee
*Assistant Examiner* — Emily J Frank
(74) *Attorney, Agent, or Firm* — Anova Law Group, PLLC

(57) ABSTRACT

Pixel circuit, display panel and display device are provided. The pixel circuit includes a driving module, a data writing module, a first reset module, a threshold compensation module, light emitting control modules, a leakage suppression module, a storage capacitor, a first capacitor, and a light emitting module. A first terminal of the first reset module is electrically connected to a reference signal terminal. A first terminal of the threshold compensation module is electrically connected to a second terminal of the driving module. A control terminal of the driving module is electrically connected to a first node. A second terminal of the first reset module and a second terminal of the threshold compensation module are both electrically connected to the first node through the leakage suppression module. A connection node between the leakage suppression module and the second terminal of the first reset module is a second node.

22 Claims, 21 Drawing Sheets

(52) U.S. Cl.
CPC ..... *G09G 2310/061* (2013.01); *G09G 2320/0214* (2013.01)

(56) References Cited

U.S. PATENT DOCUMENTS

| | | | | |
|---|---|---|---|---|
| 2016/0372037 | A1* | 12/2016 | Lim | H01L 27/3265 |
| 2021/0312866 | A1* | 10/2021 | Fan | G09G 3/3258 |
| 2021/0376025 | A1* | 12/2021 | Kim | H01L 27/3262 |
| 2022/0180810 | A1* | 6/2022 | Zhang | G09G 3/3241 |

* cited by examiner

PIXEL CIRCUIT INCLUDING A LEAKAGE SUPPRESSION MODULE TO IMPROVE DISPLAY STABILITY

CROSS-REFERENCE TO RELATED APPLICATION

This application claims priority of Chinese Patent Application No. 202110960998.X, filed on Aug. 20, 2021, the entire contents of which are hereby incorporated by reference.

FIELD OF THE DISCLOSURE

The present disclosure generally relates to the field of display technology and, more particularly, relates to a pixel circuit, a display panel, and a display device.

BACKGROUND

Organic Light Emitting Diode (OLED) is one of hot spots in the field of today's display research. Compared with a Liquid Crystal Display (LCD), an OLED display has advantages of low energy consumption, low production cost, self-luminescence, wide viewing angle and fast response speed. At present, OLED display panels have begun to replace conventional LCD display panels in the display fields of mobile phones, PDAs, and digital cameras.

In an OLED display panel, OLEDs need to be driven by a pixel circuit. The pixel circuit includes a driving module. However, potential of a control terminal of the driving module may be unstable, which affects display effect.

BRIEF SUMMARY OF THE DISCLOSURE

One aspect of the present disclosure provides a pixel circuit. The pixel circuit includes a driving module, a data writing module, a first reset module, a threshold compensation module, light emitting control modules, a leakage suppression module, a storage capacitor, a first capacitor, and a light emitting module. The driving module, the light emitting control module, and the light emitting module are connected in series between a first power terminal and a second power terminal, at least one light emitting control module is electrically connected between the driving module and the first power terminal, and at least one light emitting control module is electrically connected between the driving module and the light emitting module. A first terminal of the data writing module is electrically connected to a data signal terminal, a second terminal of the data writing module is electrically connected to a first terminal of the driving module, a first plate of the storage capacitor is electrically connected to the first power terminal, and a second plate of the storage capacitor is electrically connected to a control terminal of the driving module. A first terminal of the first reset module is electrically connected to a reference signal terminal, a first terminal of the threshold compensation module is electrically connected to a second terminal of the driving module, a control terminal of the driving module is electrically connected to a first node, a second terminal of the first reset module and a second terminal of the threshold compensation module are both electrically connected to the first node through the leakage suppression module, a connection node between the leakage suppression module and the second terminal of the first reset module is a second node, a first plate of the first capacitor is electrically connected to the second node, and a second plate of the first capacitor is electrically connected to a fixed potential signal terminal.

Another aspect of the present disclosure provides a display panel including a pixel circuit. The pixel circuit includes a driving module, a data writing module, a first reset module, a threshold compensation module, light emitting control modules, a leakage suppression module, a storage capacitor, a first capacitor, and a light emitting module. The driving module, the light emitting control module, and the light emitting module are connected in series between a first power terminal and a second power terminal, at least one light emitting control module is electrically connected between the driving module and the first power terminal, and at least one light emitting control module is electrically connected between the driving module and the light emitting module. A first terminal of the data writing module is electrically connected to a data signal terminal, a second terminal of the data writing module is electrically connected to a first terminal of the driving module, a first plate of the storage capacitor is electrically connected to the first power terminal, and a second plate of the storage capacitor is electrically connected to a control terminal of the driving module. A first terminal of the first reset module is electrically connected to a reference signal terminal, a first terminal of the threshold compensation module is electrically connected to a second terminal of the driving module, a control terminal of the driving module is electrically connected to a first node, a second terminal of the first reset module and a second terminal of the threshold compensation module are both electrically connected to the first node through the leakage suppression module, a connection node between the leakage suppression module and the second terminal of the first reset module is a second node, a first plate of the first capacitor is electrically connected to the second node, and a second plate of the first capacitor is electrically connected to a fixed potential signal terminal.

Another aspect of the present disclosure provides a display device including a display panel. The display panel includes a pixel circuit. The pixel circuit includes a driving module, a data writing module, a first reset module, a threshold compensation module, light emitting control modules, a leakage suppression module, a storage capacitor, a first capacitor, and a light emitting module. The driving module, the light emitting control module, and the light emitting module are connected in series between a first power terminal and a second power terminal, at least one light emitting control module is electrically connected between the driving module and the first power terminal, and at least one light emitting control module is electrically connected between the driving module and the light emitting module. A first terminal of the data writing module is electrically connected to a data signal terminal, a second terminal of the data writing module is electrically connected to a first terminal of the driving module, a first plate of the storage capacitor is electrically connected to the first power terminal, and a second plate of the storage capacitor is electrically connected to a control terminal of the driving module. A first terminal of the first reset module is electrically connected to a reference signal terminal, a first terminal of the threshold compensation module is electrically connected to a second terminal of the driving module, a control terminal of the driving module is electrically connected to a first node, a second terminal of the first reset module and a second terminal of the threshold compensation module are both electrically connected to the first node through the leakage suppression module, a connection node between the leakage suppression module and the second terminal of the first reset module is a second node, a first plate of the first capacitor is electrically connected to the second node, and a second plate of the first capacitor is electrically connected to a fixed potential signal terminal.

Other aspects of the present disclosure can be understood by those skilled in the art in light of the description, the claims, and the drawings of the present disclosure.

BRIEF DESCRIPTION OF THE DRAWINGS

By reading a following detailed description of non-limiting embodiments with reference to accompanying drawings, other features, objectives, and advantages of the present application will become more apparent. Same or similar markers of the accompanying drawings indicate same or similar features, and the accompanying drawings are not drawn according to actual scales.

DETAILED DESCRIPTION

Features and exemplary embodiments of various aspects of the present disclosure will be described in detail below. To make objectives, technical solutions, and advantages of the present disclosure clearer, the following further describes the present disclosure in detail with reference to the accompanying drawings and the specific embodiments. The specific embodiments described herein are only configured to explain the present disclosure and are not configured to limit the present disclosure. For those skilled in the art, the present disclosure can be implemented without some of the specific details. The following description of the embodiments is only to provide a better understanding of the present disclosure by showing examples of the present disclosure.

In the present specification, relational terms such as first and second are only used to distinguish one entity or operation from another entity or operation, and do not necessarily require or imply any such actual relationship or orders between the entities or operations.

When describing a structure of a component, when a layer or an area is referred to as being "on" or "above" another layer or area, the layer or area can mean directly on another layer or area or includes other layers or areas between the layer or area and another layer or area. Moreover, if the component is turned over, the layer or area will be "below" or "underneath" another layer or area.

The embodiments of the present disclosure provide a pixel circuit, a display panel, and a display device. The pixel circuit, the display panel, and the display device will be described below with reference to the accompanying drawings.

Figure 1:
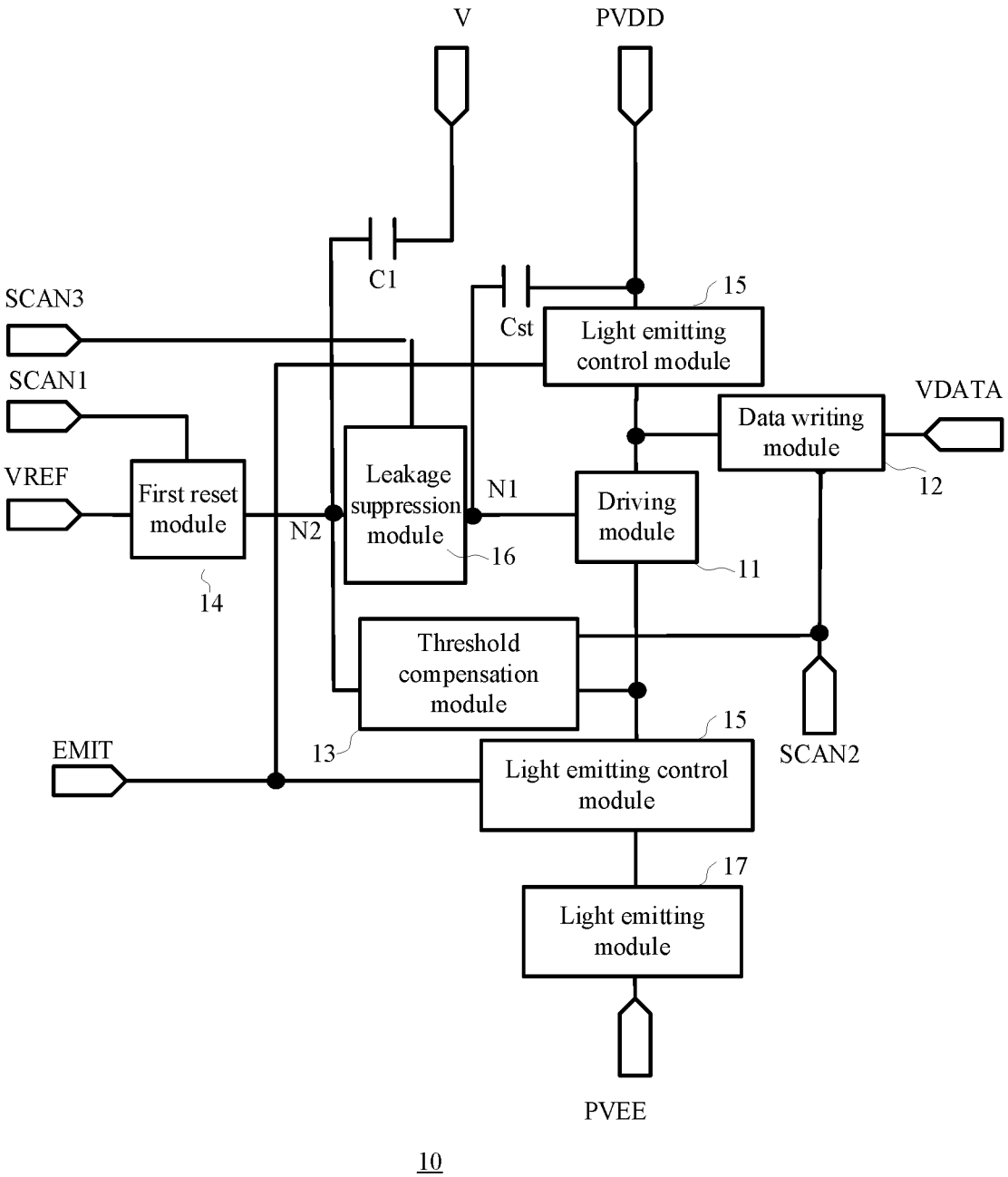
FIG. 1 illustrates a schematic diagram of a pixel circuit consistent with various embodiments of the present disclosure.
Figure 2:
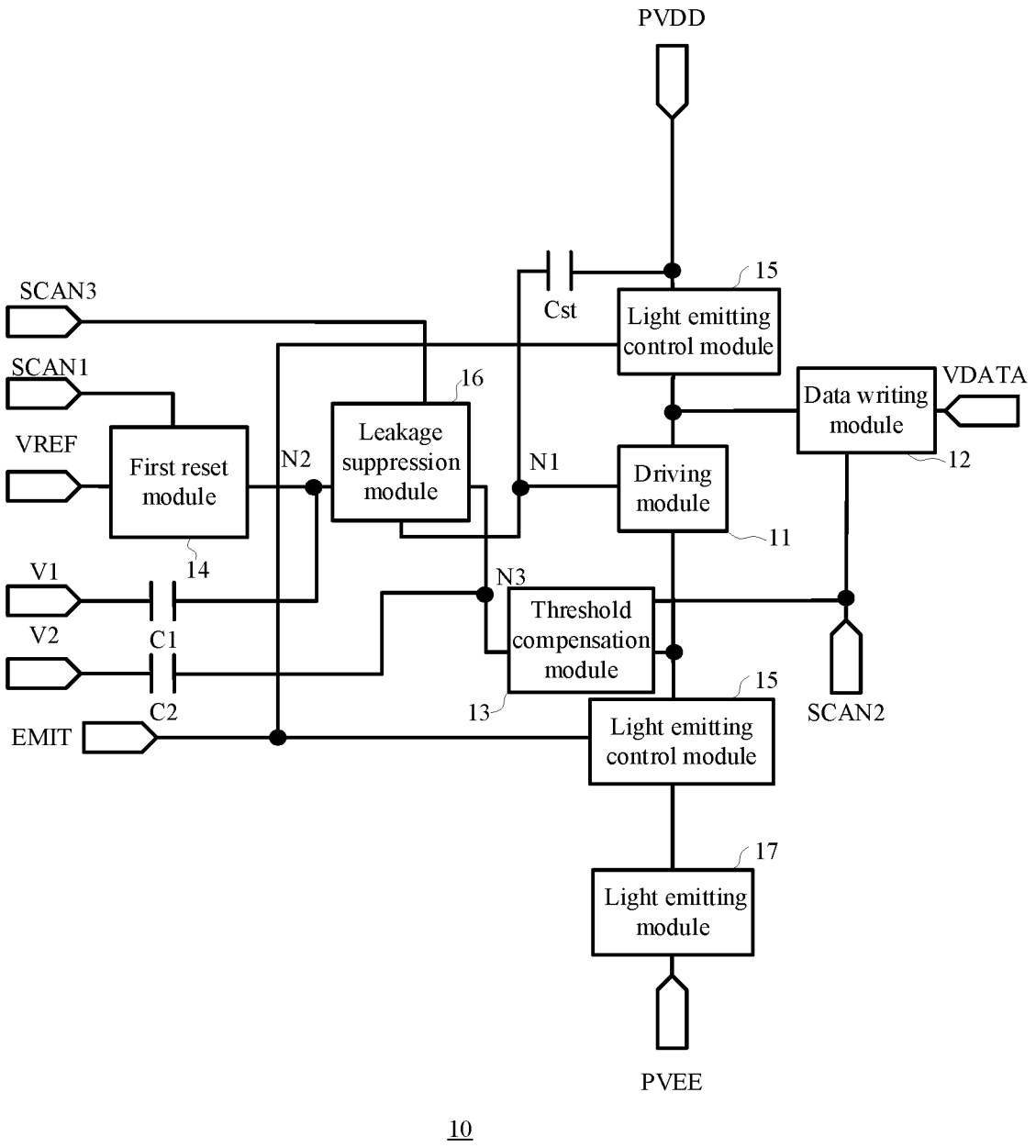
FIG. 2 illustrates another schematic diagram of a pixel circuit consistent with various embodiments of the present disclosure.

As shown in FIG. 1 or FIG. 2, a pixel circuit 10 includes a driving module 11, a data writing module 12, a threshold compensation module 13, a first reset module 14, light emitting control modules 15, a leakage suppression module 16, a light emitting module 17, a storage capacitor Cst and a first capacitor C1.

The driving module 11, the light emitting control modules 15 and the light emitting module 17 are connected in series between a first power terminal PVDD and a second power terminal PVEE. At least one light emitting control module 15 is electrically connected between the driving module 11 and the first power terminal PVDD. At least one light emitting control module 15 is electrically connected between the driving module 11 and the light emitting module 17.

Exemplarily, number of the light emitting control modules 15 may be two. One light emitting control module 15 is electrically connected between the driving module 11 and the first power terminal PVDD. The other light emitting control module 15 is electrically connected between the driving module 11 and the light emitting module 17.

The first power terminal PVDD can provide a positive polarity voltage, and the second power terminal PVEE can provide a negative polarity voltage. For example, a voltage range of the first power terminal PVDD may be 3.3V~4.6V, for example, a voltage of the first power terminal PVDD may be 3.3V, 4V, 4.6V, etc. A voltage range of the second power terminal PVEE may be −3.5V~−2V, for example, a voltage of the second power terminal PVEE may be −2V, −3V, −3.5V, etc.

A first terminal of the data writing module 12 is electrically connected to a data signal terminal VDATA, and a second terminal of the data writing module 12 is electrically connected to a first terminal of the driving module 11. The data writing module 12 is used to write a data signal of the data signal terminal VDATA into the first terminal of the driving module 11.

A first plate of the storage capacitor Cst is electrically connected to the first power terminal PVDD. A second plate of the storage capacitor Cst is electrically connected to a control terminal of the driving module 11. The control terminal of the driving module 11 is electrically connected to a first node N1. The second plate of the storage capacitor Cst is electrically connected to the first node N1. The storage capacitor Cst is used to store charges written into the control terminal of the driving module 11.

A first terminal of the first reset module 14 is electrically connected to a reference signal terminal VREF, a first terminal of the threshold compensation module 13 is electrically connected to a second terminal of the driving module 11. A second terminal of the first reset module 14 and a second terminal of the threshold compensation module 13 are both electrically connected to the first node N1 through the leakage suppression module 16. A connection node between the leakage suppression module 16 and a second terminal of the first reset module 14 is a second node N2. A first plate of the first capacitor C1 is electrically connected to the second node N2, and a second plate of the first capacitor C1 is electrically connected to a fixed potential signal terminal V.

For example, as shown in FIG. 1, the second terminal of the first reset module 14 and the second terminal of the threshold compensation module 13 may both be connected to the second node N2, so that the second terminal of the first reset module 14 and the second terminal of the threshold compensation module 13 are both electrically connected to the first node N1 through the leakage suppression module 16. For another example, as shown in FIG. 2, the second terminal of the first reset module 14 can be connected to the second node N2, the second terminal of the threshold compensation module 13 can be connected to a third node N3, the second node N2 and the third node N3 are connected to the leakage suppression module 16, so that the second terminal of the first reset module 14 and the second terminal of the threshold compensation module 13 are both electrically connected to the first node N1 through the leakage suppression module 16.

When the first reset module 14 and the leakage suppression module 16 are both in a turning-on state, a reference signal of the reference signal terminal VREF is written into the control terminal of the driving module 11 to reset a potential of the control terminal of the driving module 11. Exemplarily, the reference signal terminal VREF may provide a negative polarity voltage. For example, the voltage range of the reference signal terminal VREF may be −4.5V~−3V such as −3V, −4V, −4.5 V, etc. In addition, when the data writing module 12, the threshold compensation module 13 and the leakage suppression module 16 are all in a turning-on state, a data signal of the data signal terminal VDATA is written into the control terminal of the driving module 11, and a threshold voltage of the driving module 11 is compensated.

Figure 3:
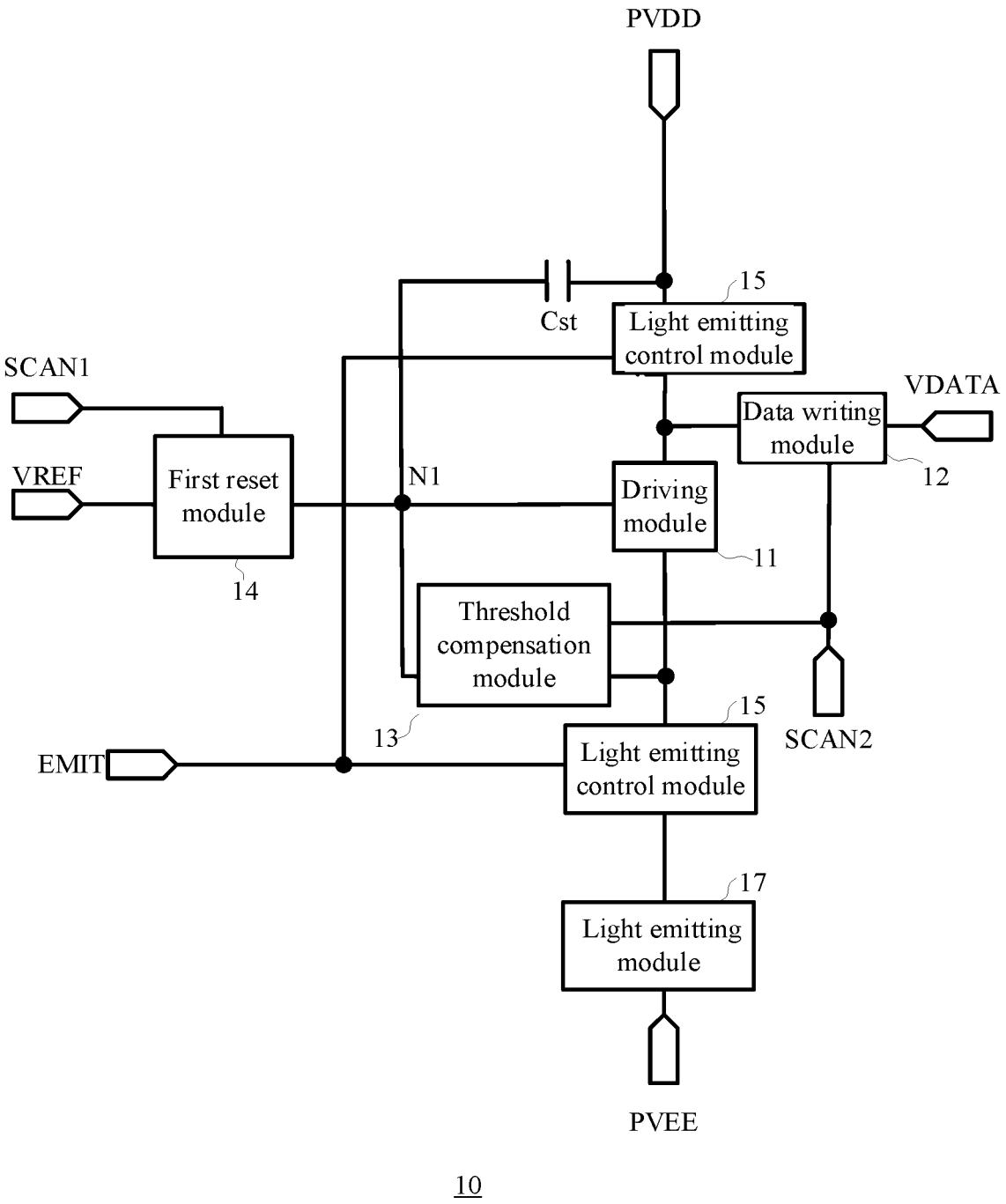
FIG. 3 illustrates a schematic diagram of a pixel circuit.

To better understand functions of the leakage suppression module 16 and the first capacitor C1 in the present disclosure, FIG. 3 illustrates a schematic diagram of a pixel circuit. A difference between FIG. 3 and FIG. 1 or FIG. 2 is that the leakage suppression module 16 and the first capacitor C1 are not provided in FIG. 3. Referring to FIG. 3, in a light emitting phase, the first reset module 14 should be in a closed state, but due to a leakage current of the first reset module 14, a potential of the first node N1 is unstable. The lower a refresh rate, the longer a leakage current time of the first reset module 14 and the more severe an impact on a potential of the first node N1, which will cause a severe jitter during a display of the display panel and affect a display effect.

In the embodiments of the present disclosure, on the one hand, since the leakage suppression module 16 is connected between the driving module 11 and the first reset module 14, an influence of a leakage current on the potential of the control terminal of the driving module 11 caused by an incomplete turning-off of the first reset module 14 in the light emitting phase can be reduced. On the other hand, by providing the leakage suppression module 16 and the first capacitor C1, even if the first reset module 14 has a leakage current in the light emitting phase, the second plate of the first capacitor C1 is electrically connected to the fixed potential signal terminal, due to a coupling effect of the first capacitor C1, a potential of the second node N2 can be basically maintained stable in the light emitting phase, so that a cross voltage between the first node N1 and the second node N2 is low, and the leakage suppression module 16 has almost no leakage current flow in the light emitting phase, thereby avoiding affecting the potential of the first node N1, improving a potential stability of the control terminal of the driving module 11 and improving a display effect.

In some optional embodiments, referring to FIG. 1 and/or FIG. 2, a control terminal of the first reset module 14 can be electrically connected to a first scan signal terminal SCAN1. A control terminal of the threshold compensation module 13 can be electrically connected to a second scan signal terminal SCAN2. A control terminal of the leakage suppression module 16 can be electrically connected to a third scan signal terminal SCAN3.

Exemplarily, a control terminal of the data writing module 12 may be electrically connected to the second scan signal terminal SCAN2. A control terminal of the lighting control module 15 can be electrically connected to a lighting control signal terminal EMIT.

Figure 4:
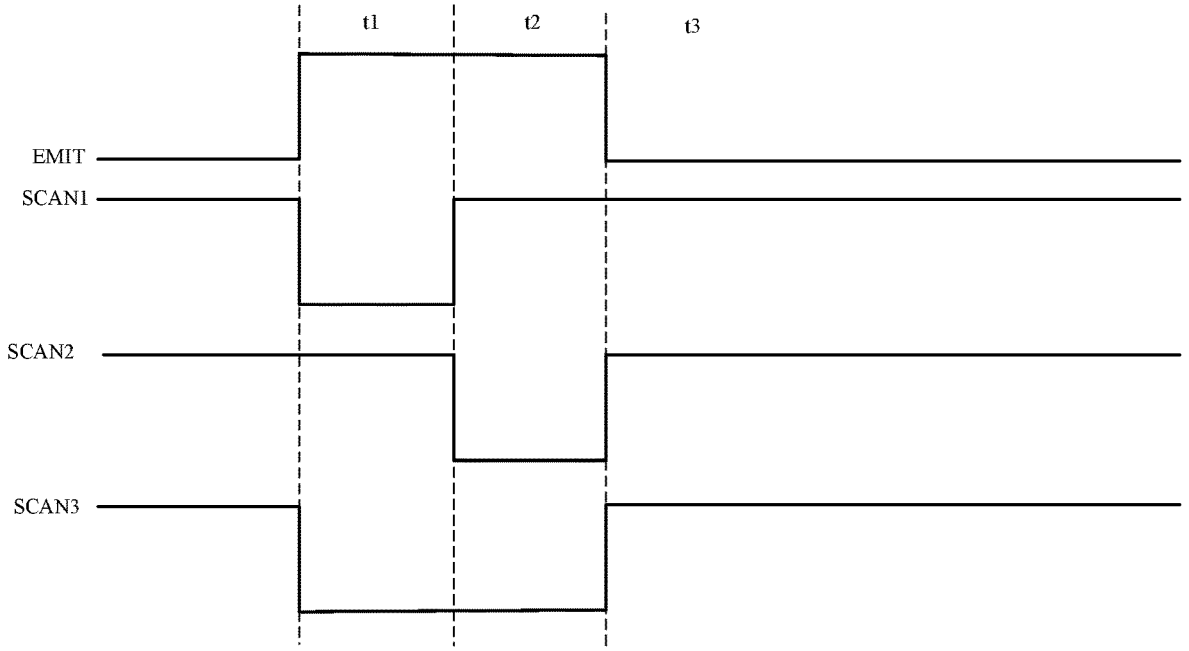
FIG. 4 illustrates a timing diagram consistent with various embodiments of the present disclosure.

As shown in FIG. 4, a driving process of the pixel circuit 10 may include a reset phase t1, a data writing phase t2, and a light emitting phase t3. Taking functional modules of the pixel circuit 10 being turned on at a low level as an example, and referring to FIGS. 1 and 4, in the reset phase t1, the first scan signal terminal SCAN1 and the third scan signal terminal SCAN3 provide low level signals. The first reset module 14 and the leakage suppression module 16 are turned on to reset a control terminal potential of the driving module 11. In the data writing phase t2, the second scan signal terminal SCAN2 and the third scan signal terminal SCAN3 provide low-level signals. The data writing module 12, the threshold compensation module 13 and the leakage suppression module 16 are turned on. A data signal on the data signal terminal VDATA is written to the control terminal of the driving module 11, and the threshold voltage of the driving module 11 is compensated. In the light emitting phase t3, the light emitting control signal terminal EMIT provides a low-level signal, the light emitting control modules 15 are turned on, a driving current generated by the driving module 11 is transmitted to the light emitting module 17, and the light emitting module 17 emits lights.

Taking FIG. 4 as an example, in the data writing phase t2, the potential of the second node N2 is same as the potential of the first node N1. In the light emitting phase even if there is a leakage current in the first reset module 14, due to a voltage stabilizing effect of the first capacitor C1, the potential of the second node N2 remains basically stable. Therefore, a cross voltage between the first node N1 and the second node N2 will be relatively low, so that almost no leakage current flows through the leakage suppression module 16 in the light emitting phase, and the potential of the first node N1 may also remain almost unchanged. At a low refresh rate, a jitter in the display panel can be avoided or improved.

Figure 5:
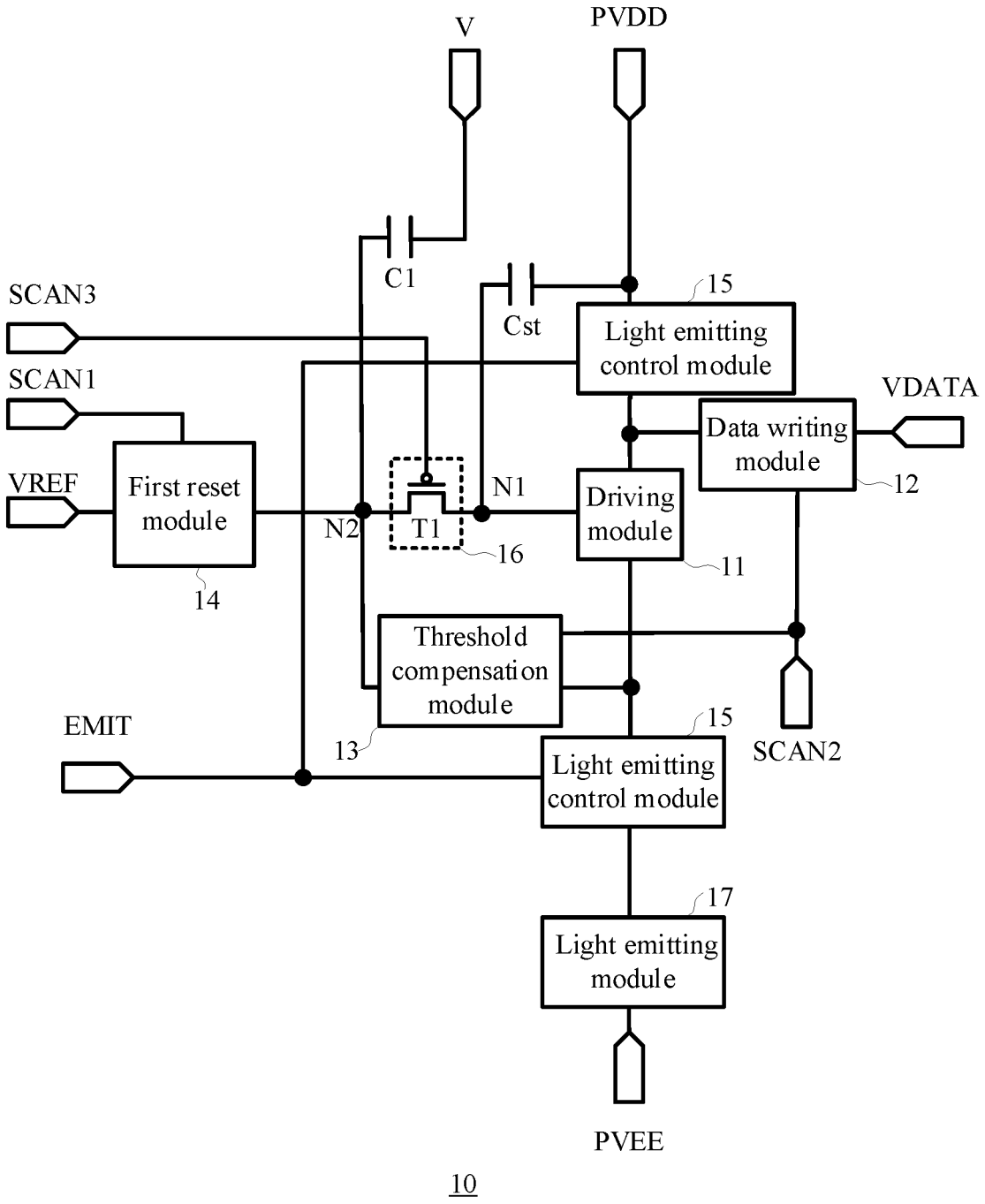
FIG. 5 illustrates another schematic diagram of a pixel circuit consistent with various embodiments of the present disclosure.

In some optional embodiments, the second terminal of the first reset module 14 and the second terminal of the threshold compensation module 13 may both be connected to the second node N2. As shown in FIG. 5, the leakage suppression module 16 may include a first transistor T1. A first electrode of the first transistor T1 is electrically connected to the second node N2, and a second electrode of the first transistor T1 is electrically connected to the first node N1. A gate of the first transistor T1 is electrically connected to the third scan signal terminal SCAN3. The second terminal of the threshold compensation module 13 is electrically connected to the second node N2. The gate of the first transistor T1 is the control terminal of the leakage suppression module 16.

Referring to FIG. 3, in the light emitting phase, the threshold compensation module 13 may also have a leakage current. In a case where the second terminal of the first reset module 14 and the second terminal of the threshold compensation module 13 are both connected to the second node N2, even if the first reset module 14 and the threshold compensation module 13 both have a leakage current, due to a voltage stabilization effect of the first capacitor C1, the leakage suppression module 16 has almost no leakage current in the light emitting phase. Therefore, only one first capacitor needs to be provided to avoid an influence of the leakage current of the first reset module 14 and an influence of the threshold compensation module 13 on the potential of the first node N1 at a same time, thereby maintaining a stability of the control terminal potential of the driving module 11.

As shown in FIG. 5, the first transistor T1 may be a single-gate transistor.

Figure 6:
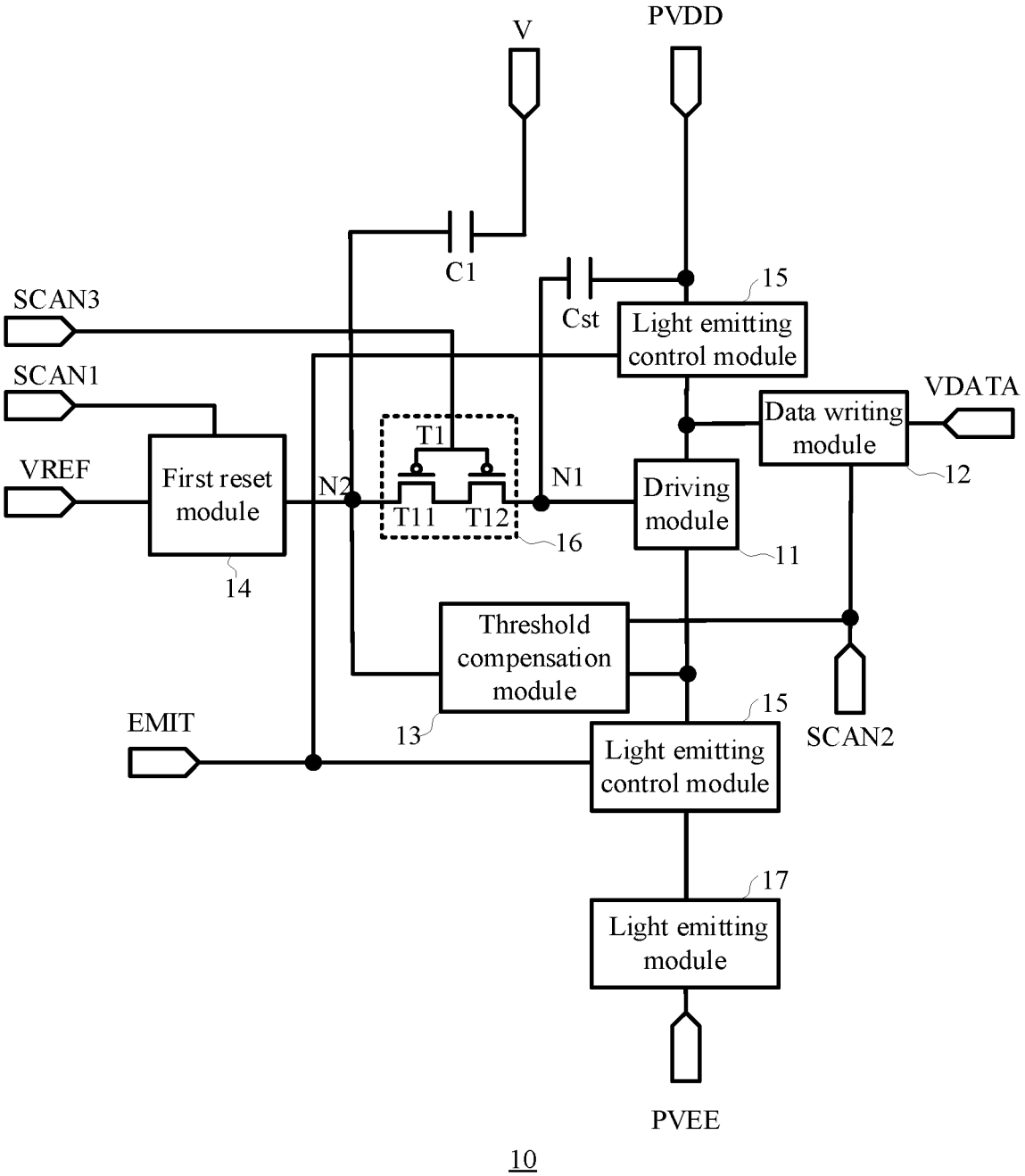
FIG. 6 illustrates another schematic diagram of a pixel circuit consistent with various embodiments of the present disclosure.

In other optional embodiments, as shown in FIG. 6, the first transistor T1 may be a double-gate transistor. Exemplarily, the first transistor T1 includes a first sub-transistor T11 and a second sub-transistor T12. A gate of the first sub-transistor T11 and a gate of the second sub-transistor T12 are electrically connected to the third scan signal terminal SCAN3. A first electrode of the first sub-transistor T11 is electrically connected to the second node N2, a second electrode of the first sub-transistor T11 is electrically connected to a first electrode of the second sub-transistor T12, and a second electrode of the second sub-transistor T12 is electrically connected to the first node N1.

The gate of the first sub-transistor T11 and the gate of the second sub-transistor T12 are both control terminals of the leakage suppression module 16. At a same moment, the first sub-transistor T11 and the second sub-transistor T12 have a same turning-on or turning-off state.

In one embodiment, since the first transistor T1 is a double-gate transistor, the double-gate transistor has a better leakage suppression, and therefore can further stabilize the potential of the first node N1.

In some optional embodiments, the second terminal of the first reset module 14 may be connected to the second node N2, the second terminal of the threshold compensation module 13 can be connected to the third node N3, the second node N2 and the third node N3 are both connected to the leakage suppression module 16, so that the second terminal of the first reset module 14 and the second terminal of the threshold compensation module 13 are both electrically connected to the first node N1 through the leakage suppression module 16.

Figure 7:
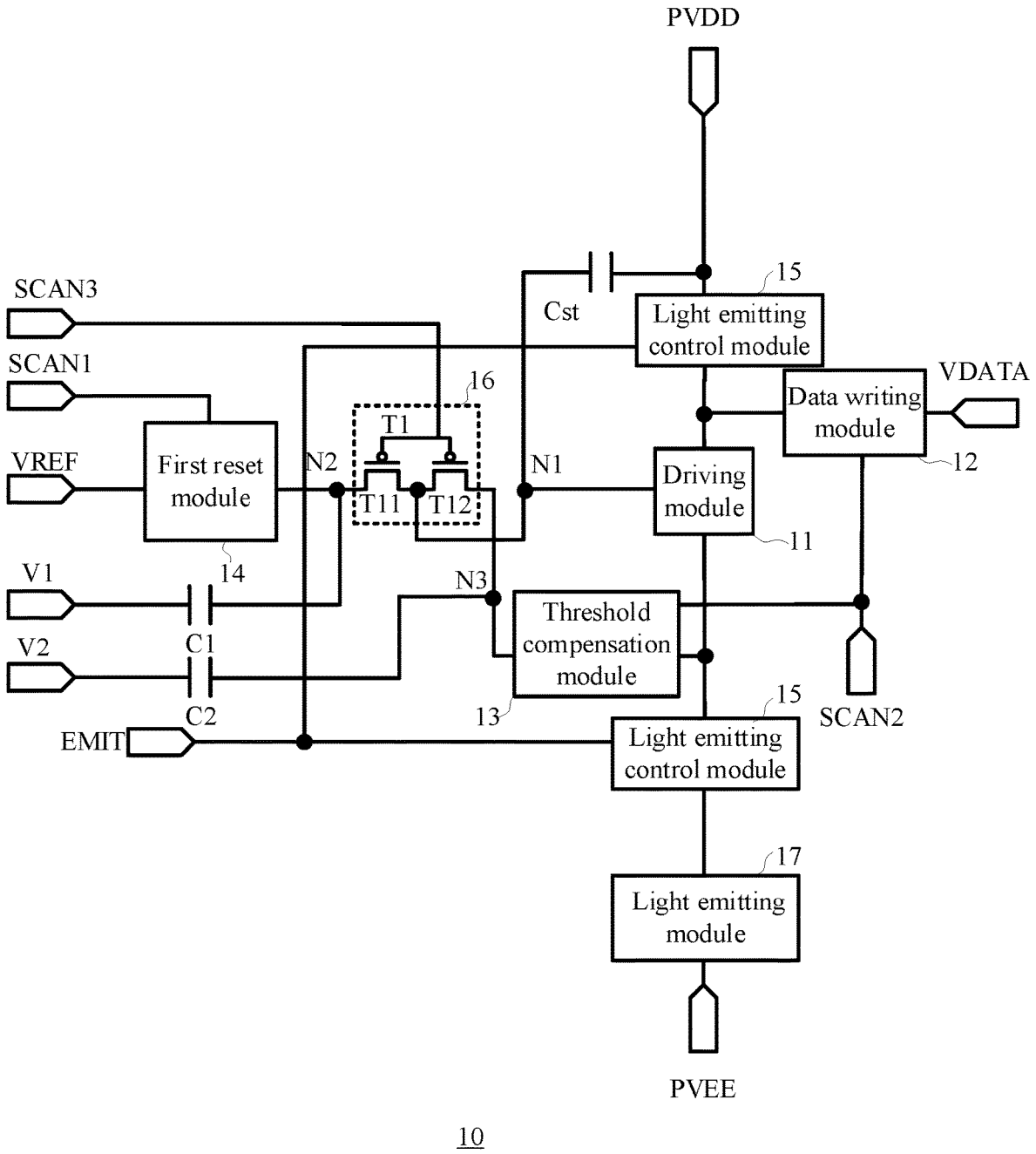
FIG. 7 illustrates another schematic diagram of a pixel circuit consistent with various embodiments of the present disclosure.

Exemplarily, as shown in FIG. 7, the leakage suppression module 16 may include the first transistor T1, and the first transistor T1 may be a double-gate transistor. Specifically, the first transistor T1 may include the first sub-transistor T11 and the second sub-transistor T12. The gate of the first sub-transistor T11 and the gate of the second sub-transistor T12 are both electrically connected to the third scan signal terminal SCAN3, the first electrode of the first sub-transistor T11 is electrically connected to the second node N2, the second electrode of the first sub-transistor T11 is electrically connected to the first node N1, the first electrode of the second sub-transistor T12 is electrically connected to the third node N3, and the second electrode of the second sub-transistor T12 is electrically connected to the first node N1. The second terminal of the threshold compensation module 13 is electrically connected to the third node N3.

Similarly, the gate of the first sub-transistor T11 and the gate of the second sub-transistor T12 are both the control terminals of the leakage suppression module 16. At a same moment, a turning-on or turning-off state of the first sub-transistor T11 and a turning-on or turning-off state of the second sub-transistor T12 are same. The second electrode of the first sub-transistor T11 and the second electrode of the second sub-transistor T12 are connected to each other.

As described above, the threshold compensation module 13 may also have a leakage current in the light emitting phase. To reduce an influence of the leakage current of the threshold compensation module 13 on the potential of the first node N1, another voltage stabilizing capacitor can be provided. Referring to FIG. 7, the pixel circuit 10 may further include a second capacitor C2, and the fixed potential signal terminal V may include a first fixed potential signal terminal V1 and a second fixed potential signal terminal V2, the second plate of the first capacitor C1 is electrically connected to the first fixed potential signal terminal V1, a first plate of the second capacitor C2 is electrically connected to the third node N3, and a second plate of the second capacitor C2 is electrically connected to the second fixed potential signal terminal V2.

Similarly, even if the threshold compensation module 13 has a leakage current in the light emitting phase, and the second capacitor C2 is electrically connected to the fixed potential signal terminal, due to a coupling effect of the second capacitor C2, the potential of the third node N3 can be basically maintained stable in the light emitting phase, so that a cross voltage between the first node N1 and the third node N3 is low and the leakage suppression module 16 has almost no leakage current flow in the light emitting phase, thereby avoiding affecting the potential of the first node N1, improving a potential stability of the control terminal of the driving module 11 and improving a display effect.

A voltage provided by the first fixed potential signal terminal V1 and a voltage provided by the second fixed potential signal terminal V2 may be different. Exemplarily, the first fixed-potential signal terminal V1 and the second fixed-potential signal terminal V2 may both provide a positive polarity voltage, or the first fixed-potential signal terminal V1 and the second fixed-potential signal terminal V2 both may provide a negative polarity voltage, or one of the first fixed-potential signal terminal V1 and the second fixed-potential signal terminal V2 may provide a positive polarity voltage and the other may provide a negative polarity voltage. For example, the first fixed potential signal terminal V1 provides a negative polarity voltage, and the second fixed potential signal terminal V2 provides a positive polarity voltage.

In some optional embodiments, the first power terminal PVDD or the reference signal terminal VREF may be multiplexed as the fixed potential signal terminal V. In a case where the fixed potential signal terminal V may include a first fixed potential signal terminal V1 and a second fixed potential signal terminal V2, one of the first power terminal PVDD and the reference signal terminal VREF may be multiplexed as the first fixed potential signal V1, the other of the first power terminal PVDD and the reference signal terminal VREF can be multiplexed as the second fixed potential signal terminal V2. There is no need to set an additional fixed potential signal terminal V, which reduces a cost.

Figure 8:
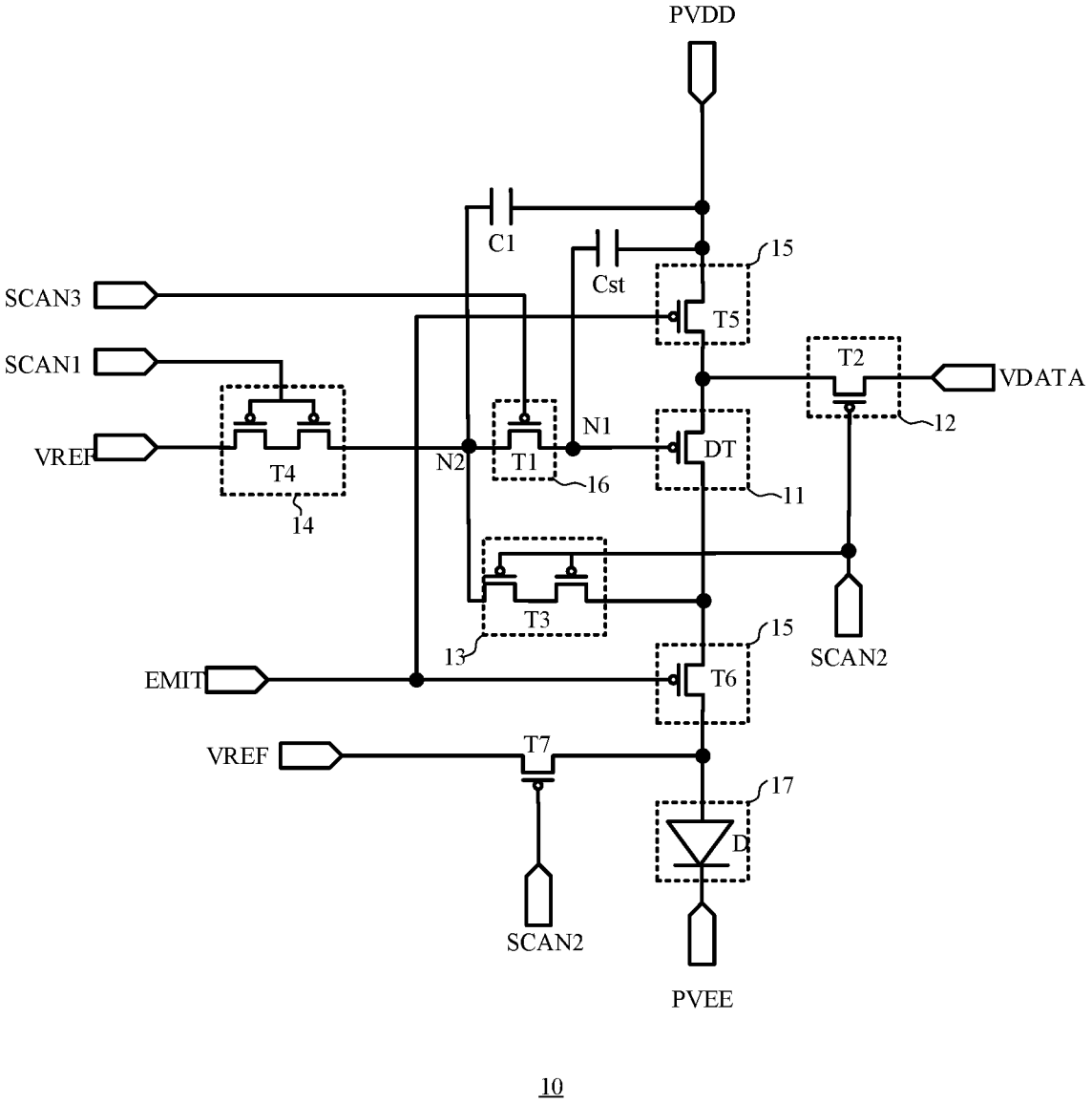
FIG. 8 illustrates another schematic diagram of a pixel circuit consistent with various embodiments of the present disclosure.
Figure 9:
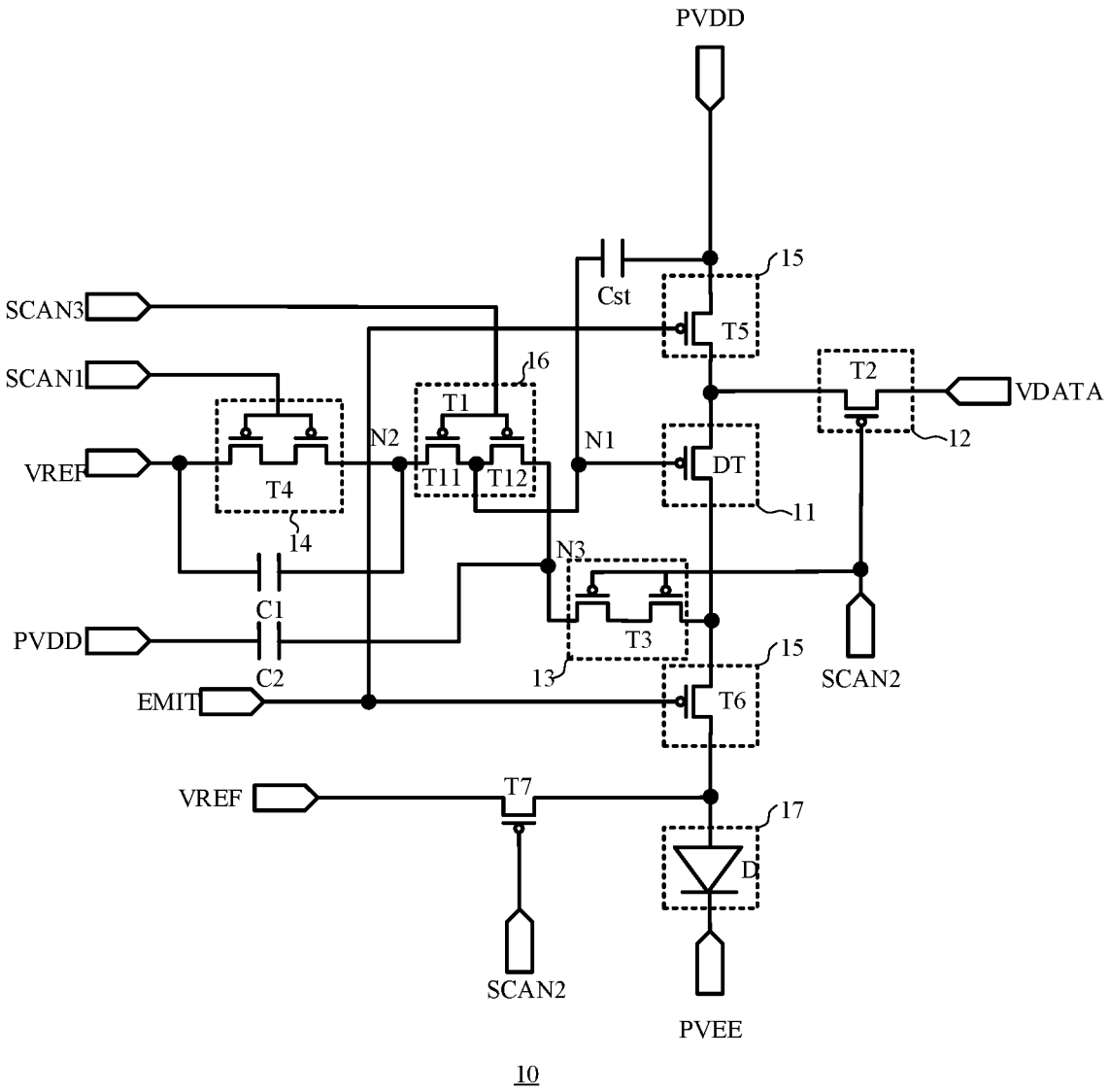
FIG. 9 illustrates another schematic diagram of a pixel circuit consistent with various embodiments of the present disclosure.

For example, as shown in FIG. 8, the second plate of the first capacitor C1 is electrically connected to the first power terminal PVDD, and the first power terminal PVDD is multiplexed as the fixed potential signal terminal. For another example, as shown in FIG. 9, the second plate of the first capacitor C1 is electrically connected to the reference signal terminal VREF, and the second plate of the second capacitor C2 is electrically connected to the first power terminal PVDD. The reference signal terminal VREF is multiplexed as the first fixed potential signal terminal V1, and the first power terminal PVDD is multiplexed as a second fixed potential signal terminal V2.

In some optional embodiments, as shown in FIG. 8 or FIG. 9, the driving module 11 includes a driving transistor DT, and the data writing module 12 includes a second transistor T2, The threshold compensation module 13 includes a third transistor T3, the first reset module 14 includes a fourth transistor T4, the light emitting control module 15 includes a fifth transistor T5 and a sixth transistor T6, the light emitting module 17 includes a light emitting diode D, and the pixel circuit 10 may also include a seventh transistor T7.

A gate of the second transistor T2 is electrically connected to the second scan signal terminal SCAN2, a first electrode of the second transistor T2 is electrically connected to the data signal terminal VDATA, and a second electrode of the second transistor T2 is electrically connected to a first electrode of the driving transistor DT.

A gate of the fifth transistor T5 is electrically connected to the light emitting control signal terminal EMIT, a first electrode of the fifth transistor T5 is electrically connected to the first power terminal PVDD, and a second electrode of the fifth transistor T5 is electrically connected to the first electrode of the driving transistor DT.

A gate of the sixth transistor T6 is electrically connected to the light emitting control signal terminal EMIT, a first electrode of the sixth transistor T6 is electrically connected to a second electrode of the driving transistor DT, and a second electrode of the sixth transistor T6 is electrically connected to a first electrode of the light emitting diode D.

A gate of the seventh transistor T7 is electrically connected to the second scan signal terminal SCAN2, a first electrode of the seventh transistor T7 is electrically connected to the reference signal terminal VREF, a second electrode of the seventh transistor T7 is electrically connected to the first electrode of the light emitting diode D and a second electrode of the light emitting diode D is electrically connected to the second power terminal PVEE. In the accompanying drawings of the present disclosure, the seventh transistor T7 is a single-gate transistor. The seventh transistor T7 may also be a double-gate transistor, which is not limited herein. In addition, in the present disclosure, the seventh transistor T7 and the first reset module 14 are both electrically connected to the reference signal terminal VREF. The seventh transistor T7 and the first reset module 14 may also be electrically connected to different reference signal terminals. For example, the seventh transistor T7 is electrically connected to a first reference signal terminal, the first reset module 14 is electrically connected to a second reference signal terminal, and the first reference signal terminal and the second reference signal terminal are different signal terminals.

A gate of the third transistor T3 is electrically connected to the second scan signal terminal SCAN2, a first electrode of the third transistor T3 is electrically connected to the second electrode of the driving transistor DT, a gate of the fourth transistor T4 is electrically connected to the first scan signal terminal SCAN1, a first electrode of the fourth transistor T4 is electrically connected to the reference signal terminal VREF, and both a second electrode of the third transistor T3 and a second electrode of the fourth transistor T4 are electrically connected to the first node N1 through the leakage suppression module 16.

Exemplarily, the first electrode of the light emitting diode D may be an anode, and the second electrode of the light emitting diode D may be a cathode. The third transistor T3 and the fourth transistor T4 may be double-gate transistors.

FIG. 8 exemplarily illustrates that the leakage suppression module 16 includes the first transistor T1, the second electrode of the third transistor T3 and the second electrode of the fourth transistor T4 are electrically connected to the second node N2, the first electrode of the first transistor T1 is electrically connected to the second node N2, and the second electrode of the first transistor T1 is electrically connected to the first node N1. FIG. 9 exemplarily illustrates that the leakage suppression module 16 includes the first transistor T1, the first transistor T1 includes a first sub-transistor T11 and a second sub-transistor T12, the second electrode of the fourth transistor T4 is electrically connected to the second node N2, a first electrode of the first sub-transistor T11 is electrically connected to the second node N2, the second electrode of the third transistor T3 is electrically connected to the third node N3, a first electrode of the second sub-transistor T12 is electrically connected to the third node N3, and a second electrode of the first sub-transistor T11 and a second electrode of the second sub-transistor T12 are both electrically connected to the first node N1.

Exemplarily, each transistor in the pixel circuit may be a low temperature poly-silicon (LTPS) thin film transistor, or may be an oxide thin film transistor, such as an indium gallium zinc oxide (Indium Gallium Zinc Oxide, IGZO) thin film transistor, which is not limited herein. Exemplarily, the transistors in the pixel circuit may be P-type transistors or N-type transistors. An enable level of the P-type transistor is a level, and an enable level of the N-type transistor is a high level. A enable level is a level at which the transistor can be turned on.

To better understand a working process of the pixel circuit, take an example that each transistor in the pixel circuit is a P-type transistor. Referring to FIG. 4 and FIG. 8, in the reset phase t1, the first scan signal terminal SCAN1 and the third scan signal terminal SCAN3 provide low-level signals, the fourth transistor T4 and the first transistor T1 are turned on, a signal of the reference signal terminal VREF is written into the first node N1, and a gate potential of the driving transistor DT is reset. In the data writing phase t2, the second scan signal terminal SCAN2 and the third scan signal terminal SCAN3 provide low-level signals, the second transistor T2, the third transistor T3, and the first transistor T1 are turned on, a data signal on the data signal terminal VDATA is written to the first node N1, and a threshold voltage of the driving transistor DT is compensated. In addition, the seventh transistor T7 is turned on, a signal of the reference signal terminal VREF is written into the first electrode of the light emitting diode D, and a potential of the first electrode of the light emitting diode D is reset. In the light emitting phase t3, the light emitting control signal terminal EMIT provides a low-level signal, the fifth transistor T5 and the sixth transistor T6 are turned on, a driving current generated by the driving transistor DT is transmitted to the light emitting diode D, and the light emitting diode D emits light.

Exemplarily, in the present disclosure, gates of a plurality of transistors are all connected to the second scan signal terminal SCAN2 (that is, the second scan signal terminal SCAN2 is shared). The second scan signal terminal SCAN2 may not be shared. Whether each of the signal terminals is shared can be determined according to a working process of a specific pixel circuit.

Figure 10:
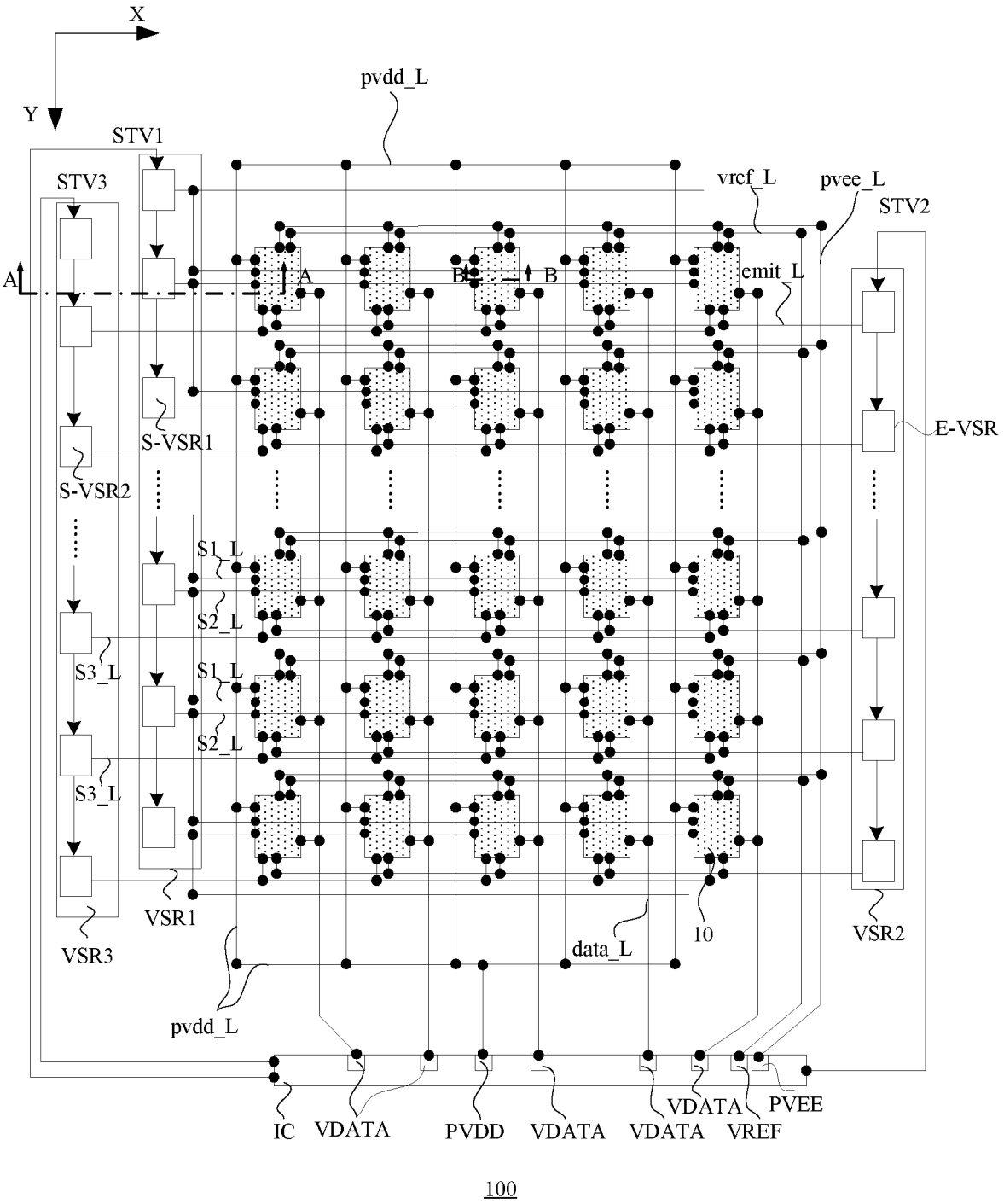
FIG. 10 illustrates a top view of a display panel consistent with various embodiments of the present disclosure.

As shown in FIG. 10, a display panel 100 is provided in one embodiment. Exemplarily, the display panel may support a low frequency mode and a high frequency mode. For example, the low frequency mode may include a refresh rate less than 60 Hz, such as 30 Hz, 15 Hz, etc. The high frequency mode can include a refresh rate greater than or equal to 60 Hz, such as 60 Hz, 90 Hz, 120 Hz, 144 Hz, etc.

The display panel 100 may include a pixel circuit 10 of any of the above embodiments. Therefore, the display panel 100 includes beneficial effects of the pixel circuit 10 of any of the above embodiments, which will not be described in detail herein.

Exemplarily, a plurality of pixel circuits 10 may be distributed in an array. For example, the plurality of pixel circuits 10 may be arranged in an array in a first direction X and a second direction Y intersected to each other. Exemplarily, the first direction X may be a row direction, and the second direction Y may be a column direction. The first direction X may also be a column direction, and the second direction Y may also be a row direction.

Figure 11:
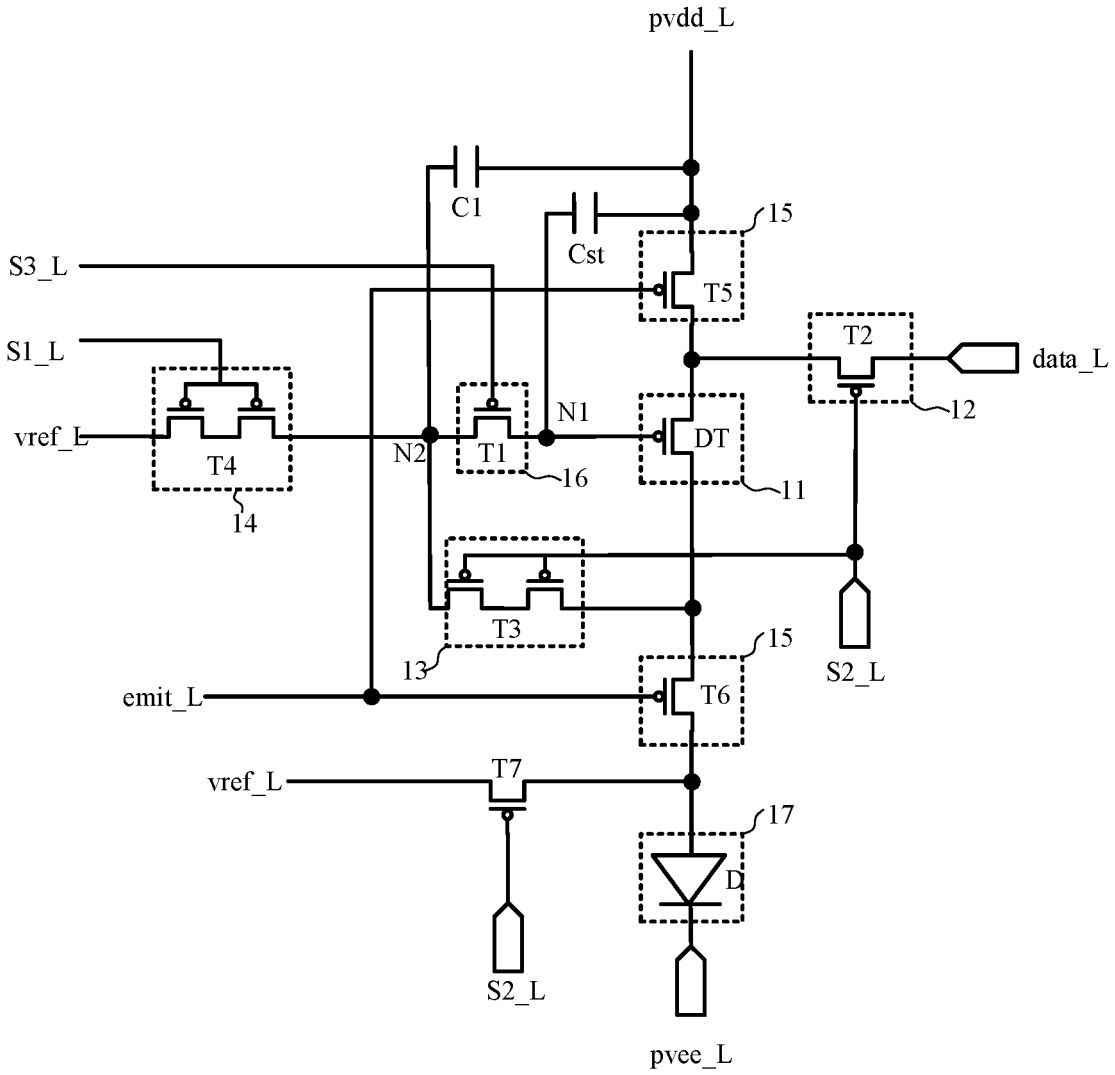
FIG. 11 illustrates another schematic diagram of a pixel circuit consistent with various embodiments of the present disclosure.

Exemplarily, the display panel 100 may further include a first power line pvdd_L, a second power line pvee_L, a fixed potential signal line V_L, a data line data_L, a reference signal line vref_L, scan lines S1_L, S2_L, S3_L, and a light emitting control signal line emit_L. In addition, FIG. 10 and FIG. 11 illustrate that the first power line pvdd_L is multiplexed as the fixed potential signal line V_L. The fixed potential signal line V_L can also be separately provided, which is not limited herein. Exemplarily, the light emitting module 17 may include light emitting elements, and the second power line pvee_L is electrically connected to cathodes of the light emitting elements. The cathode of each light emitting element in the display panel may form a whole surface structure, that is, the cathode scan occupy a display area of the display panel. A connection between the second power line pvee_L and the pixel circuit in FIG. 11 is only an illustration and is not used to limit the present disclosure.

Functional modules included in the pixel circuit 10 shown in FIG. 11 are same as functional modules of the pixel circuit shown in FIG. 1. A difference between FIG. 11 and FIG. 1 is that, in FIG. 11, the driving module 11, the light emitting control modules 15 and the light emitting module 17 are connected in series between the first power line pvdd_L and the second power line pvee_L, the first terminal of the data writing module 12 is electrically connected to the data line data_L, the first terminal of the first reset module 14 is electrically connected to the reference signal line vref_L, and the control terminal of the first reset module 14 is electrically connected to a first scan line S1_L. The control terminal of the data writing module 12 and the control terminal of the threshold compensation module 13 are electrically connected to the second scan line S2_L, and the control terminal of the current containment module 16 is electrically connected to the third scan line S3_L. That is, in FIG. 1, the functional modules of the pixel circuit are connected to signal terminals, and in FIG. 11, the functional modules of the pixel circuit are connected to signal lines.

Exemplarily, the first power supply line pvdd_L is electrically connected to the first power terminal PVDD, and the first power terminal PVDD provides a voltage signal to the pixel circuit through the first power supply line pvdd_L. The second power supply line pvee_L is electrically connected to the second power terminal PVEE, and the second power terminal PVEE provides a voltage signal to the pixel circuit through the second power supply line pvee_L. The reference signal line vref_L is electrically connected to the reference signal terminal VREF, and the reference signal terminal VREF provides a voltage signal to the pixel circuit through the reference signal line vref_L. The data line data_L is electrically connected to the data signal terminal VDATA, and the data signal terminal VDATA provides a data signal to the pixel circuit through the data line data_L. The first scan line S1_L is electrically connected to the first scan signal terminal SCAN1, the second scan line S2_L is electrically connected to the first scan signal terminal SCAN2, the third scan line S3_L is electrically connected to the third scan signal terminal SCAN3, and each scan signal terminal provides a scan signal to the pixel circuit through a corresponding scan line. The light emitting control signal line emit_L is electrically connected to the light emitting control signal terminal EMIT, and the light emitting control signal terminal EMIT provides a light emitting control signal to the pixel circuit through the light emitting control signal line emit_L.

Exemplarily, the display panel may further include a driving chip IC, a first gate driving circuit VSR1, a second gate driving circuit VSR2, and a third gate driving circuit VSR3. The driving chip IC may include a first power terminal PVDD, a second power terminal PVEE, a reference signal terminal VREF, and a data signal terminal VDATA.

The first gate driving circuit VSR1 may include a plurality of cascaded shift registers S-VSR1. Each shift register S-VSR1 includes a scanning signal terminal. The scanning signal terminal of each shift register S-VSR1 is connected to the pixel circuit 10 through a scanning signal line. The first gate driving circuit VSR1 is used to provide the scanning signal to the pixel circuit 10.

Exemplarily, referring to FIG. 10, taking the pixel circuit in an i-th row (i is a positive integer) and the pixel circuit in an i+1th row as an example, the second scan line S2_L corresponding to the pixel circuit in the i-th row and the first scan line S1_L corresponding to the circuit in the i+1th row may be electrically connected to the scan signal end of the j-th (j is an integer) stage shift register S-VSR1. That is, a scan signal terminal of the j-th stage shift register S-VSR1 can be used as a second scan signal terminal corresponding to the pixel circuit in the i-th row and a first scan signal terminal corresponding to the pixel circuit in the i+1-th row. The scan signals transmitted by the second scan line S2_L corresponding to the pixel circuit and the first scan line S1_L corresponding to the pixel circuit in the i+1th row may be same.

The driving chip IC provides a first start signal STV1 for the first gate driving circuit VSR1. In addition, as shown in FIG. 10, in the plurality of cascaded shift registers S-VSR1, except for a first and a last stage shift registers S-VSR1, the remaining shift registers S-VSR1 can provide scanning signals for two adjacent rows of pixel circuits 10. Two rows of dummy pixel circuits (not shown) can be arranged on an array substrate, which are respectively connected to scan lines of the first and the last stage shift register S-VSR1 in the shift register S-VSR1, but the dummy pixel circuits are not used for display.

The second gate driving circuit VSR2 may include a plurality of cascaded shift registers E-VSR. Each shift register E-VSR includes a light emitting control signal terminal. The light emitting control signal terminal of each shift register E-VSR is connected to the pixel circuit 10 through the light emitting control signal line emit_L. The second gate driving circuit VSR2 is used to provide a light emitting control signal to the pixel circuit 10. The driving chip IC provides a second start signal STV2 for the second gate driving circuit VSR2.

The third gate driving circuit VSR3 may include a plurality of cascaded shift registers S-VSR2. Each shift register S-VSR2 includes a scanning signal terminal. The scanning signal terminal of each shift register S-VSR2 is connected to the pixel circuit 10 through a scanning signal line. The third gate driving circuit VSR3 is used to provide a light emitting control signal to the pixel circuit 10. The driving chip IC provides a third start signal STV3 for the third gate driving circuit VSR3. A scan signal terminal of each shift register S-VSR2 can be referred to as a third scan signal end.

The first gate driving circuit VSR1, the second gate driving circuit VSR2, and the third gate driving circuit VSR3 introduced in FIG. 10 are just some examples and are not intended to limit the present disclosure.

In some optional pixel circuit designs, as shown in FIG. 11, the pixel circuit may also include a transistor T7. The second scan signal line S2_L can also be multiplexed to control a turning-on or turning-off of the transistor T7 of the pixel circuit and reset an anode potential of the light emitting module when the transistor T7 is turned on. There is no need to separately set scan lines for the transistor T7.

Figure 12:
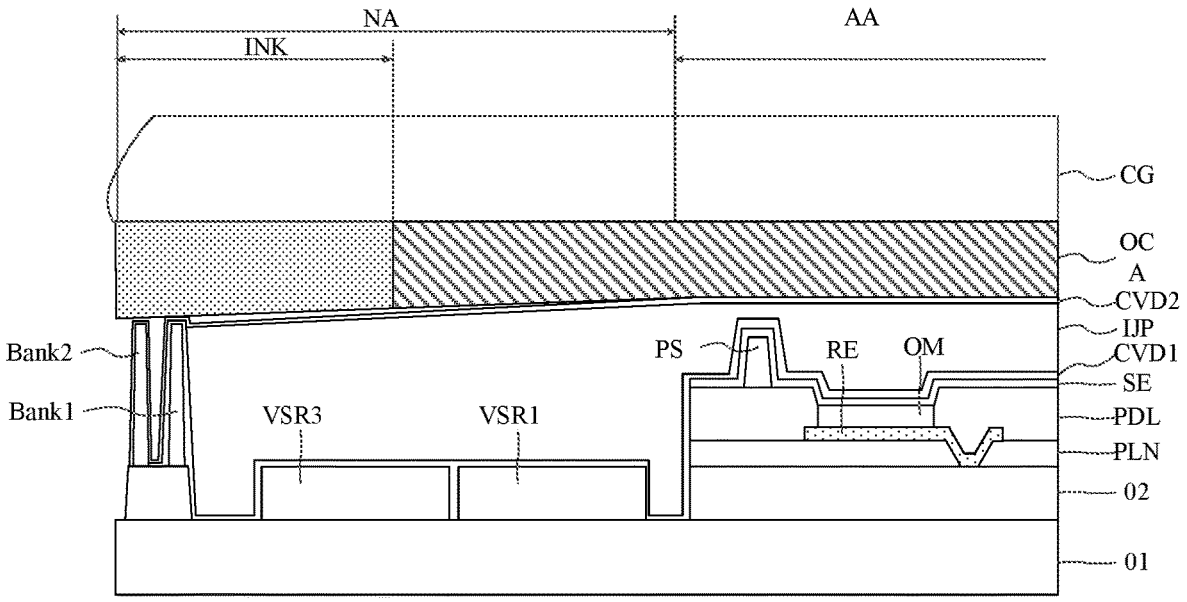
FIG. 12 illustrates a cross-sectional view in a direction of A-A in FIG. 10.
Figure 13:
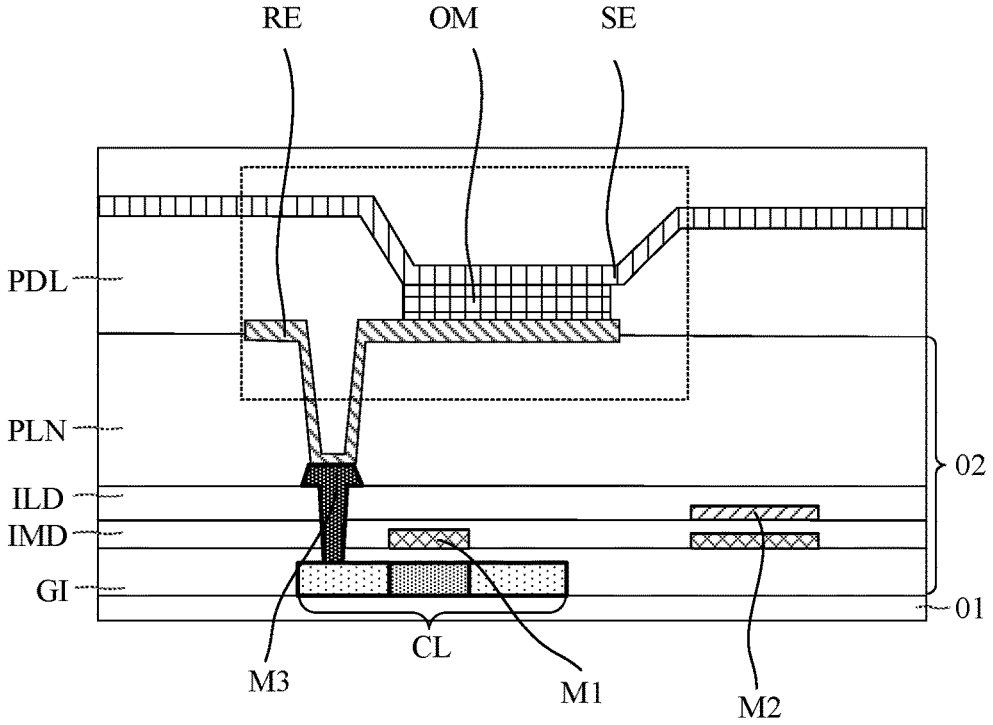
FIG. 13 illustrates a cross-sectional view in a direction of B-B in FIG. 10.

To better understand a structure of the display panel provided by the embodiments, FIG. 12 illustrates a cross-sectional view in a direction of A-A in FIG. 10 and FIG. 13 illustrates a cross-sectional view in a direction of B-B in FIG. 10. As shown in FIG. 12, the display panel may include a display area AA and a non-display area NA. The non-display NA may include an ink area INK. Exemplarily, the display panel includes a substrate 01 and a driving circuit layer 02 disposed on one side of the substrate 01. FIG. 12 also shows a planarization layer PLN, a pixel definition layer PDL, a light emitting element (the light emitting element includes an anode RE, an organic light emitting layer OM, and a cathode SE), a support pillar PS, a thin-film encapsulation layer including a first inorganic layer CVD1, an organic layer IJP and a second inorganic layer CVD2), an optical adhesive layer OCA, and a cover plate CG. In addition, FIG. 12 also shows the first gate driving circuit VSR1, a first barrier wall Bank1, and a second barrier wall Bank2. The first gate driving circuit VSR1 may be disposed in the non-display area NA of the driving circuit layer 02.

The pixel circuit 10 may be disposed in the driving circuit layer 02, and the pixel circuit 10 is connected to the anode RE of the light emitting element. As shown in FIG. 13, the driving circuit layer 02 of the display panel may include a first metal layer M1, a second metal layer M2, and a third metal layer M3 stacked in a direction away from the substrate 01. A semiconductor layer CL is disposed between the first metal layer M1 and the substrate 01. An insulating layer is disposed between the metal layers and between the semiconductor layer CL and the first metal layer M1. Exemplarily, a gate insulating layer GI is disposed between the first metal layer M1 and the semiconductor layer CL, a capacitor insulating layer IMD is disposed between the second metal layer M2 and the first metal layer M1, and the third metal layer M3 is connected to the first metal layer M3. An interlayer dielectric layer ILD is disposed between the two metal layers M2.

Exemplarily, the scan lines S1_L, S2_L, S3_L and the light emitting control signal line emit_L may be disposed on the first metal layer M1. The reference signal line vref_L may be disposed on the second metal layer M2, and the first power line pvdd_L. The data line data_L may be disposed on the third metal layer M3. A film layer where each signal line is located can also be set in other ways, which is not limited herein.

Figure 14:
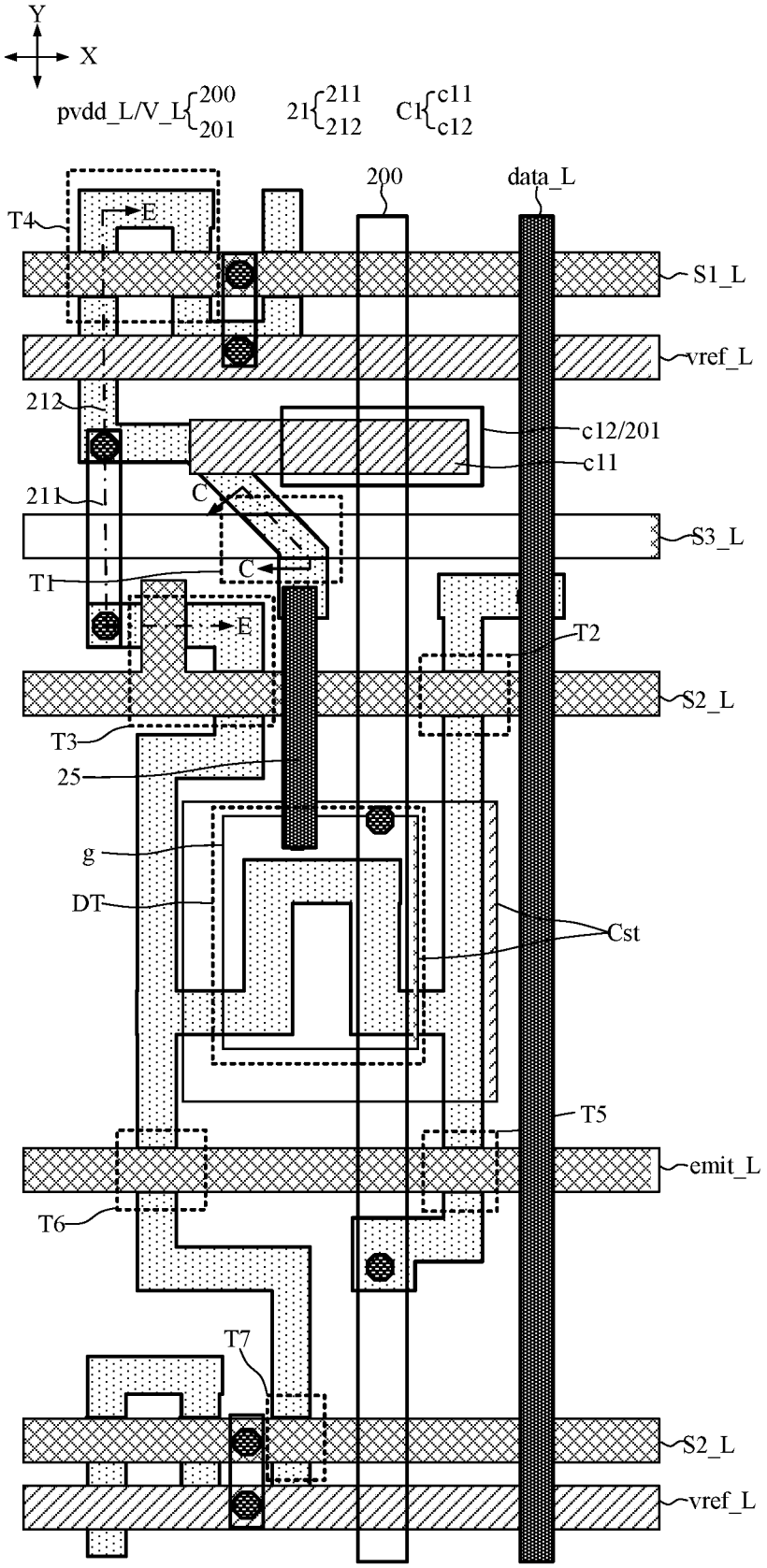
FIG. 14 illustrates a schematic diagram of a partial layout of a display panel consistent with various embodiments of the present disclosure.

The second plate of the first capacitor C1 is to be electrically connected to the fixed potential signal line V_L. As shown in FIG. 14, in some optional embodiments, at least part area of the fixed potential signal line V_L can be multiplexed as a second plate c12 of the first capacitor C1. FIG. 14 still uses the example of multiplexing the first power line pvdd_L as the fixed potential signal line V_L, that is, part area of the first power line pvdd_L is multiplexed as the second plate c12 of the first capacitor C1. There is no need to provide an additional structure as the second plate of the first capacitor C1, which can save process steps and reduce a cost.

In some optional embodiments, FIG. 11 illustrates another schematic diagram of a pixel circuit consistent with various embodiments of the present disclosure and FIG. 14 illustrates a schematic diagram of a partial layout of a display panel consistent with various embodiments of the present disclosure. An equivalent circuit diagram corresponding to FIG. 14 is shown in FIG. 11. The display panel 100 may include a first connection portion 21. The driving module 11 includes the driving transistor DT. The leakage suppression module 16 includes the first transistor T1. The data writing module 12 includes the second transistor T2. The threshold compensation module 13 includes the third transistor T3. The first reset module 14 includes the fourth transistor T4.

The first electrode of the second transistor T2 is connected to the data line data_L, the second electrode of the second transistor T2 is connected to the first electrode of the driving transistor DT. The first electrode of the third transistor T3 is connected to the second electrode of the driving transistor DT. The first electrode of the fourth transistor T4 is connected to the reference signal line vref_L. The gate of the fourth transistor T4 is connected to the first scan line S1_L. The gate of the third transistor T3 and the gate of the second transistor T2 are both connected to the second scan line Sn_L. The gate of the first transistor T1 is connected to the third scan line S3. The second electrode of the third transistor T3, the second electrode of the fourth transistor T4, and the first electrode of the first transistor T1 are all connected to the first connection portion 21. The second electrode of the first transistor T1 is electrically connected to a gate portion g of the driving transistor DT. Any node on the first connection portion 21 can be regarded as the second node N2. Exemplarily, the display panel 100 may include a fifth connection portion 25. The fifth connection portion 25 may be connected between the second electrode of the first transistor T1 and the gate part g of the driving transistor DT. Specifically, one terminal of the fifth connection portion 25 may be connected to the second electrode of the first transistor T1 through a via. One terminal of the fifth connection portion 25 may be connected to the gate portion g of the driving transistor DT through a via. Any node on the fifth connection portion 25 can be regarded as the first node N1.

Although the third transistor T3 and the fourth transistor T4 are both illustrated as double-gate transistors in the present disclosure, the third transistor T3 and the fourth transistor T4 may also be single-gate transistors or any other suitable transistors without limitation.

Figure 15:
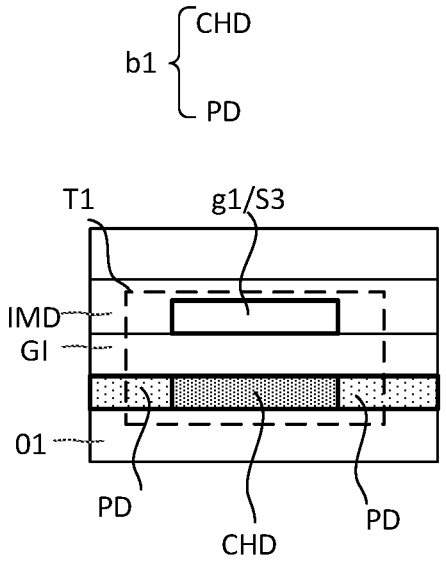
FIG. 15 illustrates a cross-sectional view in a direction of C-C in FIG. 14.

In addition, each transistor may include a semiconductor portion, and the semiconductor portion of each transistor may be disposed on the semiconductor layer CL. The semiconductor portion of each transistor may include a lightly doped region and two heavily doped regions on both sides of the lightly doped region. The two heavily doped regions can be used as the first electrode and the second electrode of the transistor respectively. The lightly doped region can be regarded as a channel region, and the two heavily doped regions can be regarded as a source region and a drain region. One of the first electrode and the second electrode of the transistor is a source electrode and the other electrode is a drain electrode. Taking the first transistor T1 as an example, as shown in FIG. 15, the semiconductor portion b1 of the first transistor T1 includes a lightly doped region CHD and two heavily doped regions PD located on both sides of the lightly doped region. The lightly doped region CHD overlaps a gate g1 of the first transistor T1, and the two heavily doped regions PD do not overlap the gate g1 of the first transistor T1. The third scan line S3 can be multiplexed as the gate g1 of the first transistor T1.

Referring to FIG. 14, the first connection portion 21 may be electrically connected to a first plate c11 of the first capacitor C1. The fixed potential signal line V_L may include a first body portion 200 and a first branch portion 201 that are connected to each other. An orthographic projection of the first branch portion 201 on the substrate 01 overlaps an orthographic projection of the first plate c11 of the first capacitor C1 on the substrate 01. The first branch portion 201 is the second plate c12 of the first capacitor C1. In an example shown in FIG. 14, a structure as the first electrode plate c11 of the first capacitor C1 is separately disposed.

The first branch portion 201 is multiplexed as the second plate c12 of the first capacitor C1, so there is no need to separately dispose an additional structure as the second plate of the first capacitor C1, which can reduce the cost.

The first electrode plate c11 of the first capacitor C1 and the first connection portion 21 can be disposed on different film layers. The first electrode plate c11 of the first capacitor C1 can be connected to the first connection portion 21 through a via. For example, the first electrode plate c11 may be disposed on the second metal layer M2, and a partial area of the first connection portion 21 may be disposed on the semiconductor layer CL. In addition, since the first body portion 200 and the first branch portion 201 are connected to each other, a potential of the first body portion 200 and a potential of the first branch portion 201 are same.

In some optional embodiments, FIG. 14 illustrates a schematic diagram of a partial layout of a display panel consistent with various embodiments of the present disclosure. The first power line pvdd_L can be multiplexed as the fixed potential signal line V_L. The first electrode plate c11 of the first capacitor C1 and the reference signal line vref_L may be located on a same film layer. The first branch portion 201 and the first body portion 200 may be located on a same film layer. Further, a material of the first plate c11 of the first capacitor C1 and a material of the reference signal line vref_L may be same. Therefore, the first electrode plate c11 of the first capacitor C1 and the reference signal line vref_L can be simultaneously formed in a same process step. The first branch portion 201 and the first body portion 200 may be made of a same material. Therefore, the first branch portion 201 and the first body portion 200 can be formed at a same time in a same process step.

For example, the first electrode plate c11 and the reference signal line vref_L of the first capacitor C1 may be disposed on the second metal layer M2. The first branch portion 201 and the first body portion 200 may be disposed on the third metal layer M3.

Figure 16:
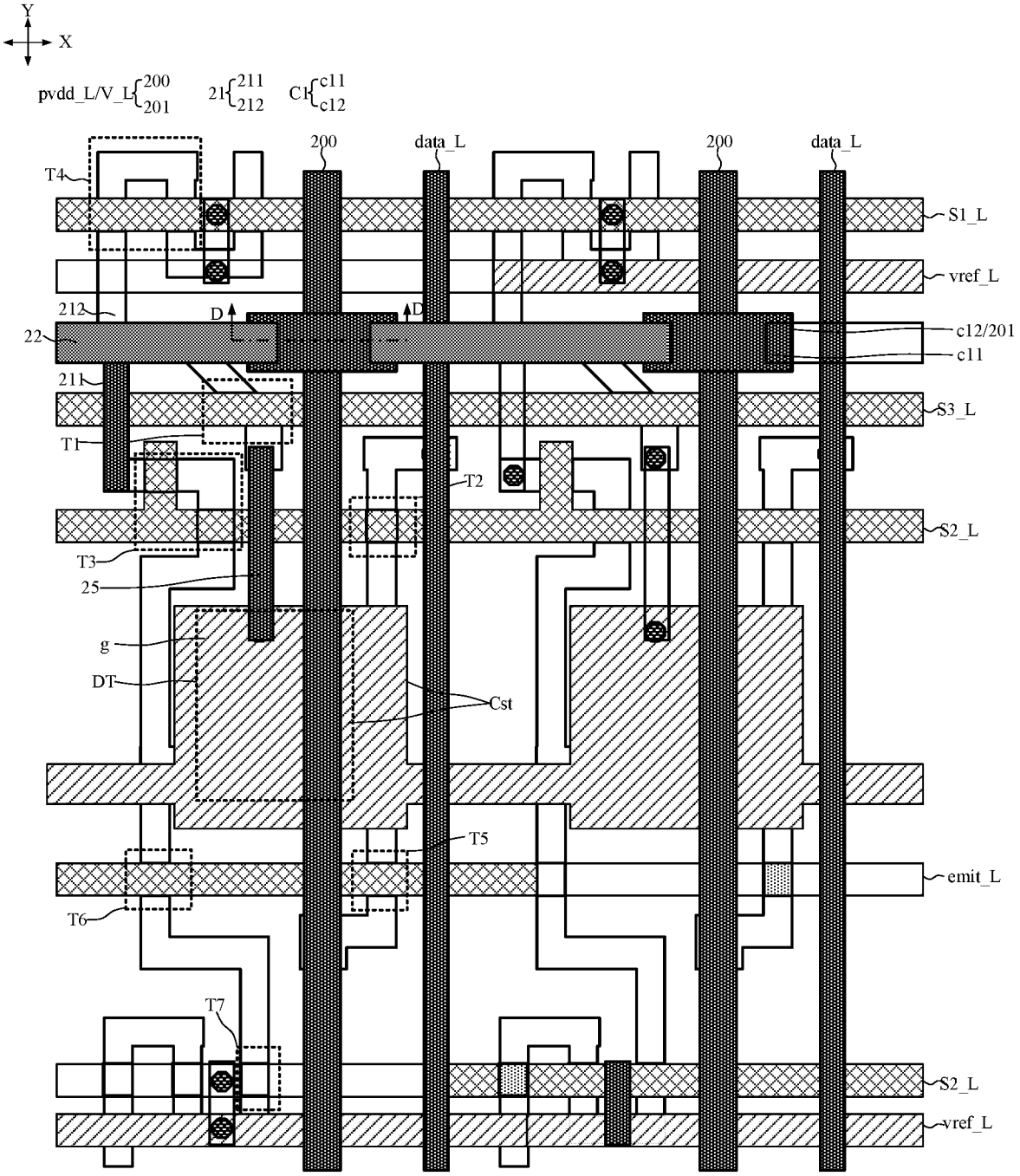
FIG. 16 illustrates a partial layout diagram of a display panel consistent with various embodiments of the present disclosure.

In some optional embodiments, in a case where the first power line pvdd_L is multiplexed as the fixed potential signal line V_L, the first branch portion 201 may extend along the first direction X, the first body portion 200 may extend along the second direction Y, and the first direction X crosses the second direction Y. As shown in FIG. 16, the display panel 100 further includes a second connection portion 22, the second connection portion 22 extends along the first direction X, and the second connection portion 22 is connected between the adjacent first branch portions 201 in the first direction X, which is equivalent to forming a grid-shaped first power line pvdd_L, and can reduce a voltage drop (IR drop) of the first power line pvdd_L and improve a display uniformity.

Exemplarily, as shown in FIG. 16, upper plates of the storage capacitors Cst adjacent in the first direction X may also be connected to each other.

Figure 17:
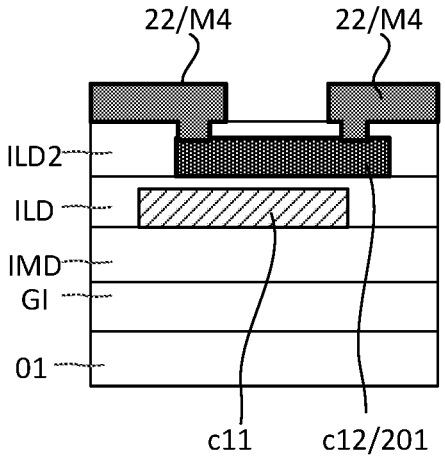
FIG. 17 illustrates a cross-sectional view in a direction of D-D in FIG. 16.

Exemplarily, the data line data_L may extend along the second direction Y, and the data line data_L, the first branch portion 201 and the first body portion 200 may be disposed on the third metal layer M3. To prevent the second connection portion 22 from being cross connected to the data line Vdata, the second connection portion 22 and the data line data_L may be disposed on different film layers. For example, the second connection portion 22 may be disposed on the second metal layer M2. For another example, as shown in FIG. 17, the display panel may further include a fourth metal layer M4. The fourth metal layer M4 is located on a side of the third metal layer M3 facing away from the substrate 01, and an insulating layer ILD2 is disposed between the fourth metal layer M4 and the third metal layer M3. The second connection portion 22 may be disposed on the fourth metal layer M4.

In exemplary layout structures, the third scan line S3_L extends along the first direction X, and a partial area of the first connection portion 21 extends along the second direction Y. The third scan line S3_L and the first connection portion 21 may inevitably cross. The third scan line S3_L can be disposed on the first metal layer M1. If an area where the first connection portion 21 and the third scan line S3_L overlap is disposed on the semiconductor layer CL, the first connection portion 21 and the third scan line S3_L constitute a transistor, which is not needed by the pixel circuit.

To avoid forming the transistor between the first connection portion 21 and the third scan line S3_L, in some optional embodiments, referring to FIG. 14, the first connection portion 21 may include a metal connection portion 211 and a semiconductor connection portion 212 that are connected to each other. An orthographic projection of the metal connection portion 211 on the substrate 01 overlaps an orthographic projection of the third scan line S3 on the substrate 01. An orthographic projection of the semiconductor connection portion 212 on the substrate 01 is spaced apart from the orthographic projection of the third scan line S3 on the substrate 01.

Figure 18:
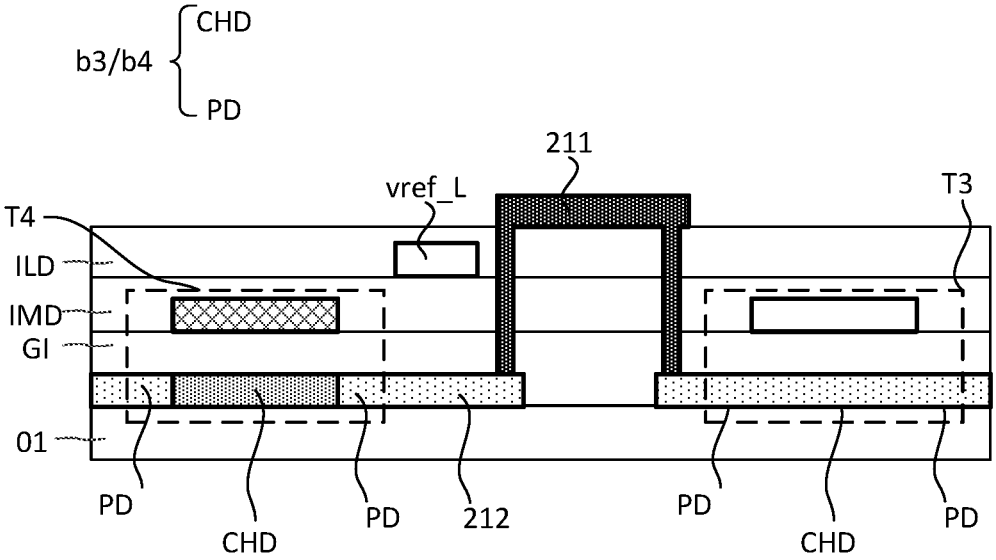
FIG. 18 illustrates a cross-sectional view in a direction of E-E in FIG. 14.

The metal connection portion 211 and the semiconductor connection portion 212 are in different film layers. As shown in FIG. 18, for example, the metal connection portion 211 may be disposed on the third metal layer M3, and the semiconductor connection portion 212 may be disposed on the semiconductor layer CL. A semiconductor portion b3 of the third transistor T3 and a semiconductor portion b4 of the fourth transistor T4 may be disposed on the semiconductor layer CL. The second electrode of the third transistor T3 can be connected to the metal connection portion 211 through a via. The second electrode of the fourth transistor T4 can be directly connected to the semiconductor connection portion 212. The metal connection portion 211 and the semiconductor connection portion 212 can be connected by a via.

Figure 19:
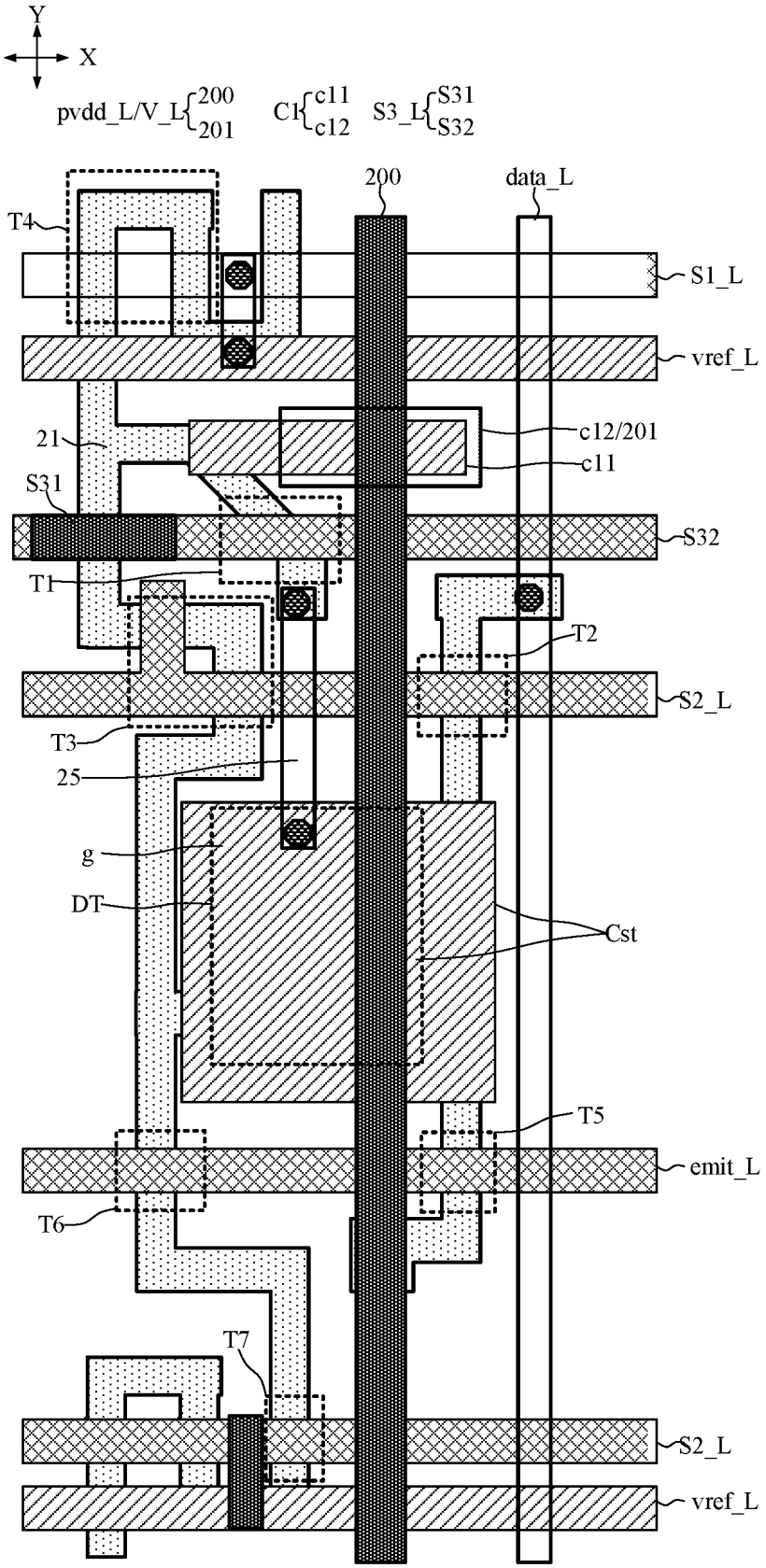
FIG. 19 illustrates another partial layout diagram of a display panel consistent with various embodiments of the present disclosure.

To avoid forming the transistor between the first connection portion 21 and the third scan line S3_L, in other optional embodiments, as shown in FIG. 19, the first connection portion 21 includes a semiconductor portion. A material of the first connection portion 21 includes a semiconductor, and the first connection portion 21 may be disposed on the semiconductor layer CL. The third scan line S3_L may include a first segment S31 and a second segment S32 connected to each other. The first segment S31 and the second segment S32 may be in different film layers. An orthographic projection of the first segment S31 on the substrate 01 overlaps an orthographic projection of the first connection portion 21 on the substrate 01. An orthographic projection of the second segment S32 on the substrate 01 is spaced apart from the orthographic projection of the first connection portion 21 on the substrate. At least part area of the second segment S32 is multiplexed as a gate of the first transistor M1. Since the second segment S32 can be multiplexed as the gate of the first transistor M1, the second segment S32 is located on the first metal layer M1, and the first segment S31 is disposed on a metal film layer outside the first metal layer M1. Therefore, although the first segment S31 and the first connection portion 21 overlap, the first segment S31 and the first connection portion 21 cannot form a transistor.

Figure 20:
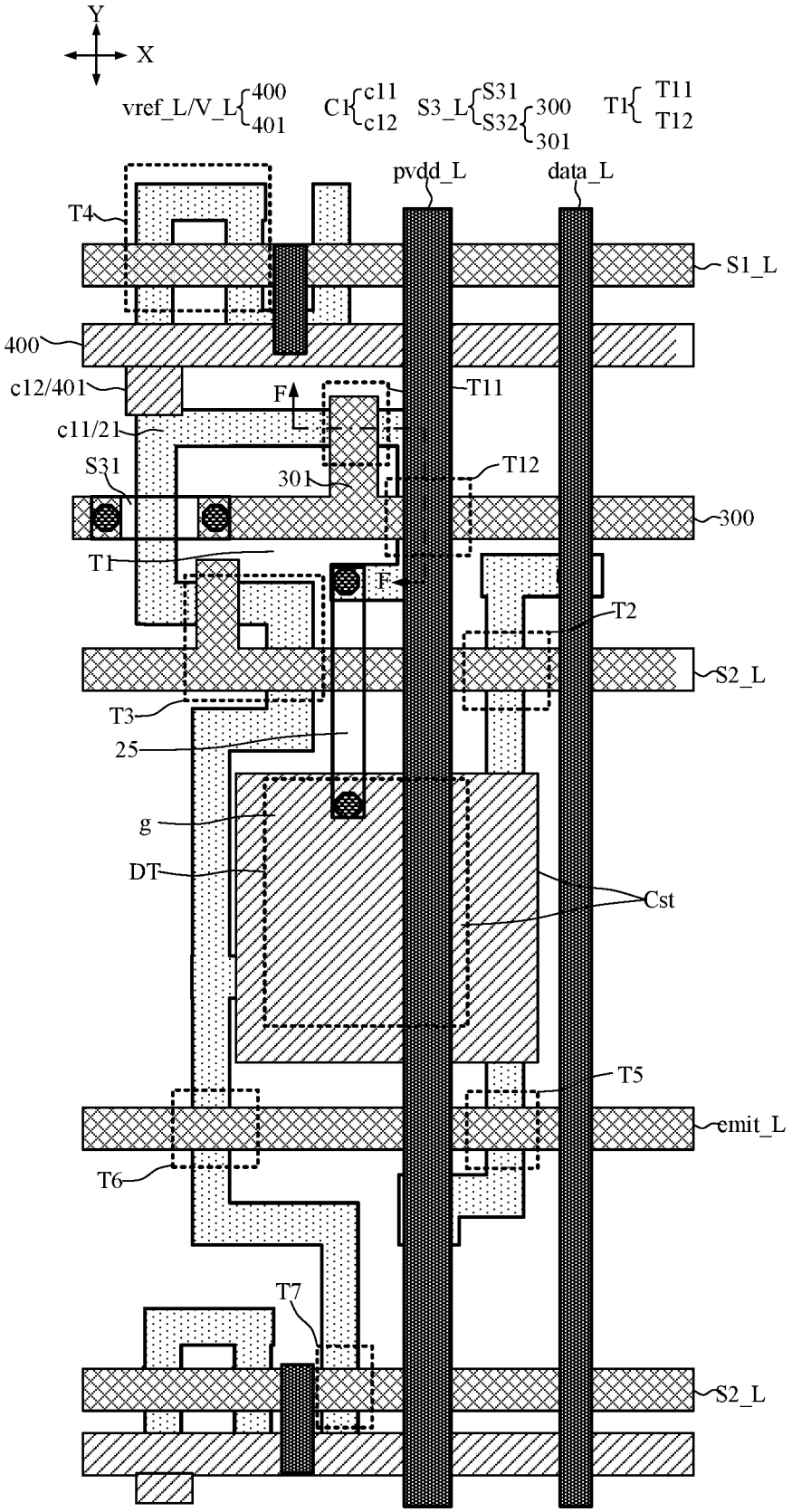
FIG. 20 illustrates another partial layout diagram of a display panel consistent with various embodiments of the present disclosure.

FIG. 14 and FIG. 16 take the first transistor M1 as a single-gate transistor as an example. In some optional embodiments, the first transistor M1 may also be a double-gate transistor. As shown in FIG. 20, the second segment S32 may include a second body portion 300 and a second branch portion 301 connected to each other. An extension direction of the second body portion 300 and an extension direction of the second branch portion 301 intersect. Exemplarily, the second body portion 300 extends along the first direction X, and the second branch portion 301 extends along the second direction Y. Both an orthographic projection of the second body portion 300 on the substrate 01 and an orthographic projection of the second branch portion 301 on the substrate 01 overlap an orthographic projection of the semiconductor portion b1 of the first transistor M1 on the substrate 01.

Figure 21:
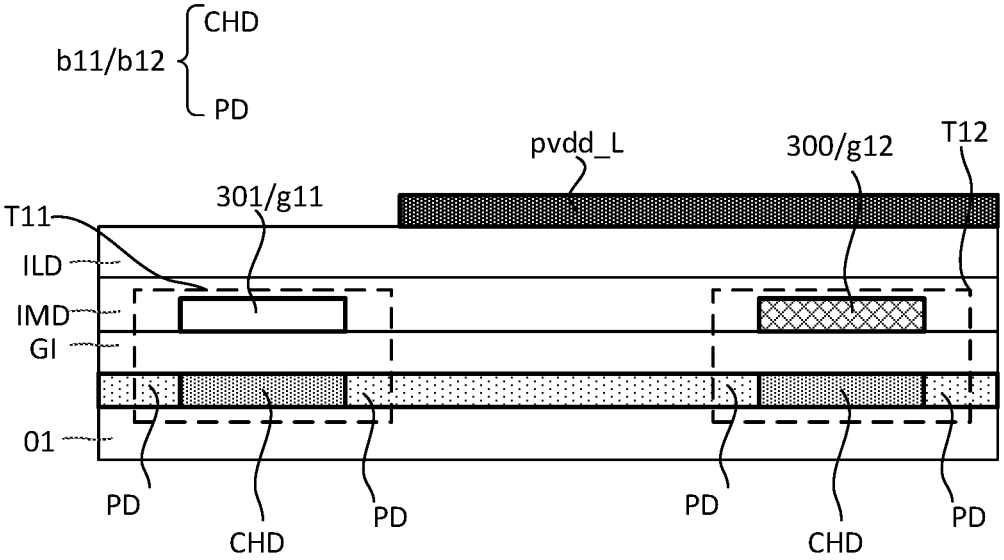
FIG. 21 illustrates a cross-sectional view in a direction of F-F in FIG. 20.

As shown in FIG. 21, the first transistor M1 includes the first sub-transistor T11 and the second sub-transistor T12. The semiconductor portion b11 of the first sub-transistor T11 and the semiconductor portion b12 of the second sub-transistor T12 both include a lightly doped region CHD and heavily doped regions PD located on both sides of each lightly doped region. An orthographic projection of the lightly doped region CHD of the semiconductor portion b12 on the substrate 01 overlaps the orthographic projection of the second body portion 300 on the substrate 01. An orthographic projection of the lightly doped region CHD of the semiconductor portion b11 on the substrate 01 overlaps the orthographic projection of the second branch portion 301 on the substrate 01. Orthographic projections of the heavily doped regions PD on the substrate 01 do not overlap the orthographic projection of the second body portion 300 and the second branch portion 301 on the substrate 01. The second body portion 300 is multiplexed as a gate g12 of the second sub-transistor T12, and the second branch portion 301 is multiplexed as a gate g11 of the first sub-transistor T11.

Since a storage capacitor plays a role of maintaining a gate potential of a driving transistor within one frame, the driving transistor needs to have a strong driving capability. Therefore, in a layout design, an area occupied by the storage capacitor and an area occupied by the driving transistor are set to be large. As shown in FIG. 20, to achieve a higher pixel density (Pixels Per Inch, PPI), an orthographic projection of the driving transistor DT on the substrate 01 can be set to overlap an orthographic projection of the storage capacitor Cst on the substrate 01. For a same pixel circuit, a space between the second scan line S2_L and the light emitting control signal line emit_L is almost occupied by the storage capacitor Cst. A space between the second scan line Sn and the second body portion 300 needs to be provided with a connection via connecting the fifth connection portion 25 and the first transistor M1. Without increasing a distance between the second scan line S2_L and the second body portion 300 in the second direction Y, a side of the second body portion 300 close to the driving transistor DT does not have enough space to place the second branch portion 301. If the distance between the second scan line S2_L and the second body portion 300 in the second direction Y is increased to achieve a purpose of arranging the second branch portion 301 on the side of the second body portion 300 close to the driving transistor DT, which is contrary to a purpose of pursuing high PPI.

In some optional embodiments, the second branch portion 301 may be located on a side of the second body portion 300 away from the driving transistor DT. That is, the second body portion 300 may be located between the second branch portion 301 and the driving transistor DT. The second body portion 300, the second branch portion 301, and the driving transistor DT refer to the second body portion 300, the second branch portion 301, and the driving transistor DT corresponding to a same pixel circuit.

The above example schematically illustrates that the first electrode plate of the first capacitor C1 needs to be additionally disposed separately. In other optional embodiments, it is not necessary to separately dispose the first plate of the first capacitor C1 separately, and the reference signal line vref_L can be multiplexed as the fixed potential signal line V_L. Exemplarily, referring to FIG. 20, the orthographic projection of the first connection portion 21 on the substrate 01 may be set to overlap an orthographic projection of the reference signal line vref_L on the substrate 01. Specifically, the reference signal line vref_L may include a third body portion 400 and a third branch portion 401, the third body portion 400 extends in the first direction X, and the third branch portion 401 extends in the second direction Y. The third body portion 400 and the third branch portion 401 may be provided with a same film layer and a same material. For example, the third body portion 400 and the third branch portion 401 are both disposed on the second metal layer M2. The orthographic projection of the first connection portion 21 on the substrate 01 is set to overlap an orthographic projection of the third branch portion 401 on the substrate 01. Therefore, the first connection portion 21 can be multiplexed as the first plate c11 of the first capacitor C1, and the third branch portion 401 can be multiplexed as the second electrode plate c12 of the first capacitor C1.

Figure 22:
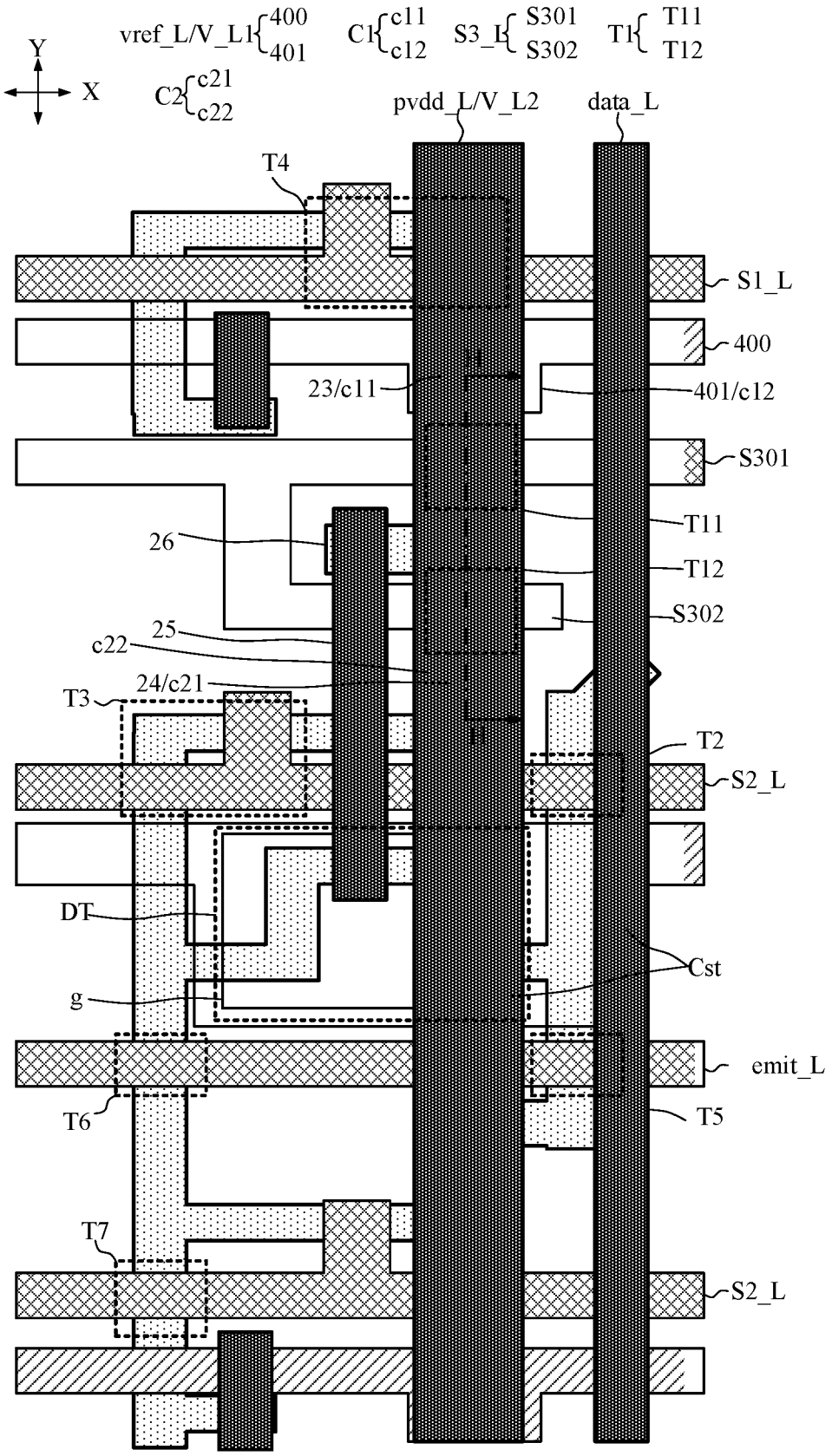
FIG. 22 illustrates another partial layout diagram of a display panel consistent with various embodiments of the present disclosure.

In some optional embodiments, referring to FIG. 9 and FIG. 22, the driving module 11 may include the driving transistor DT, the leakage suppression module 16 may include the first transistor T1, the first transistor T1 includes the first sub-transistor T11 and the second sub-transistor T12, the data writing module 12 includes the second transistor T2, the threshold compensation module 13 includes the third transistor T3, and the first reset module 14 includes the fourth transistor T4. The third transistor T3 and the fourth transistor T4 may be electrically connected to the first node N1 through different nodes.

Exemplarily, the display panel 100 may include a third connection portion 23 and a fourth connection portion 24. The first electrode of the second transistor T2 is connected to the data line data_L, the second electrode of the second transistor T2 is connected to the first electrode of the driving transistor DT, the first electrode of the third transistor T3 is connected to the second electrode of the driving transistor DT, the first electrode of the fourth transistor T4 is connected to the reference signal line vref_L. the gate of the fourth transistor T4 is connected to the first scan line S1_L, the gate of the third transistor T3 and the gate of the second transistor T2 are both connected to the second scan line S2 L, and the gate of the first transistor T1 is connected to the third scan line S3. The second electrode of the fourth transistor T4 is electrically connected to the first electrode of the first sub-transistor T11 through the third connection portion 23, the second electrode of the third transistor T3 is electrically connected to the first electrode of the second sub-transistor T12 through the fourth connection portion 24, and the second electrode of the first sub-transistor T11 and the second electrode of the second sub-transistor T12 are electrically connected to the gate portion g of the driving transistor DT.

Figure 23:
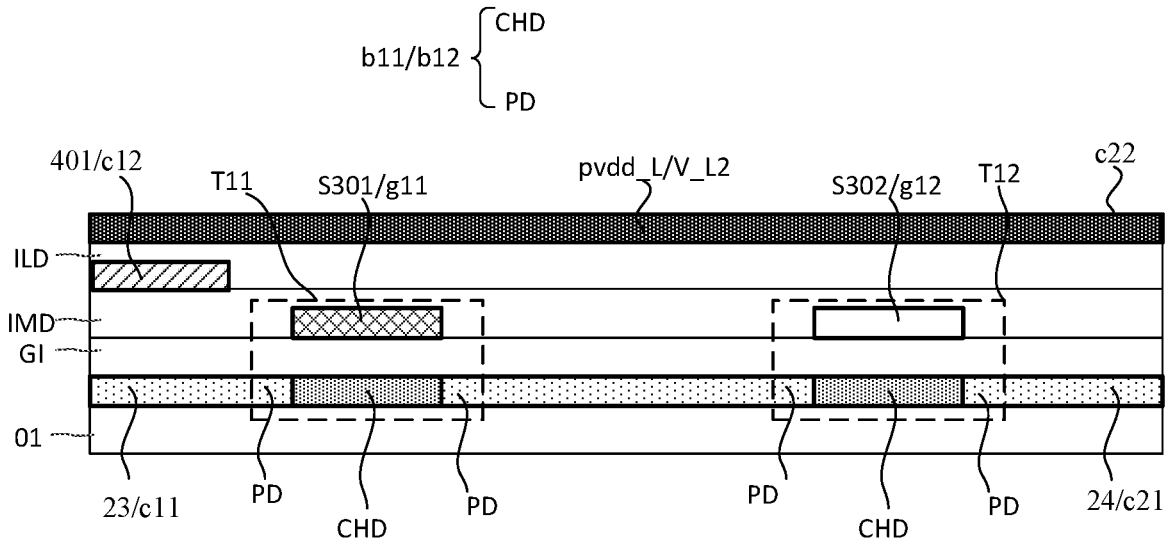
FIG. 23 illustrates a cross-sectional view in a direction of H-H in FIG. 22.

Exemplarily, the third connection portion 23 and the fourth connection portion 24 both include a semiconductor material. As shown in FIG. 23, the third connection portion 23, the fourth connection portion 24, the semiconductor portion b11 of the first sub-transistor T11, and the semiconductor portion b12 of the second sub-transistor T12 may all be disposed on the semiconductor layer CL. Exemplarily, the third scan line S3_L may include a scan body portion S301 and a scan branch portion S302, and the scan body portion S301 and the scan branch portion S302 may be disposed on the first metal layer 31. An orthographic projection of the scanning body portion S301 on the substrate 01 overlaps an orthographic projection of the semiconductor portion b11 of the first sub-transistor T11 on the substrate 01, and an orthographic projection of the scanning branch portion S302 on the substrate 01 overlaps an orthographic projection of the semiconductor portion b12 of the second sub-transistor T12 on the substrate 01. The semiconductor portion b11 and the semiconductor portion b12 may extend along the first direction X. The display panel 100 may further include an auxiliary connection portion 26. The auxiliary connection portion 26 may be disposed on the semiconductor layer CL, and a material of the auxiliary connection portion 26 may include a semiconductor. One terminal of the auxiliary connection portion 26 is connected to the semiconductor portion b11 and the semiconductor portion b12, and the other end is connected to the fifth connection portion 25 through a via.

Any node on the third connection portion 23 can be regarded as the second node N2, and any node on the fourth connection portion 24 can be regarded as the third node N3.

The fixed potential signal line V_L may include a first fixed potential signal line V_L1 and a second fixed potential signal line V_L2. An orthographic projection of the first fixed potential signal line V_L1 on the substrate 01 overlaps an orthographic projection of the third connection portion 23 on the substrate 01. An orthographic projection of the second fixed potential signal line V_L2 on the substrate 01 overlaps an orthographic projection of the fourth connection portion 24 on the substrate 01. The third connection portion 23 is multiplexed as the first plate c11 of the first capacitor C1. The first fixed potential signal line V_L1 is multiplexed as the second plate c12 of the first capacitor C1. The fourth connection portion 24 is multiplexed as a first plate c21 of the second capacitor C2. The second fixed potential signal line V_L2 is multiplexed as a second plate c22 of the second capacitor C2. Therefore, there is no need to separately set up additional structures to serve as the two plates of the first capacitor C1 and the second capacitor C2, which can reduce a cost.

In some optional embodiments, referring to FIG. 22, the reference signal line vref_L can be multiplexed as the first fixed potential signal line V_L1, and the first power line pvdd_L can be multiplexed as the second fixed potential signal line V_L2. That is, the orthographic projection of the reference signal line vref_L on the substrate 01 overlaps the orthographic projection of the third connection portion 23 on the substrate 01, and an orthographic projection of the first power line pvdd_L on the substrate 01 overlaps the orthographic projection of the fourth connection portion 24 on the substrate 01. Exemplarily, the reference signal line vref_L may include the third body portion 400 and the third branch portion 401. The third body portion 400 extends in the first direction X, and the third branch portion 401 extends in the second direction Y. The third body portion 400 and the third branch portion 401 may be provided with a same film layer and a same material. For example, the third body portion 400 and the third branch portion 401 are both disposed on the second metal layer M2. The orthographic projection of the third connection portion 23 on the substrate 01 is set to overlap the orthographic projection of the third branch portion 401 on the substrate 01. Therefore, the third connection portion 23 can be multiplexed as the first plate c11 of the first capacitor C1, and the third branch portion 401 can be multiplexed as the second plate c12 of the first capacitor C1.

In some optional embodiments, the reference signal line vref_L may also only include the third body portion 400. The third body portion 400 may be designed to be widened. The orthographic projection of the third connection portion 23 on the substrate 01 is set to overlap an orthographic projection of the third body portion 400 on the substrate 01, so that an overlapping area of the third body portion 400 and the third connection portion 23 is multiplexed as the second electrode plate c12 of the first capacitor C1.

It should be noted that the above embodiments can be combined with each other if there is no contradiction.

Figure 24:
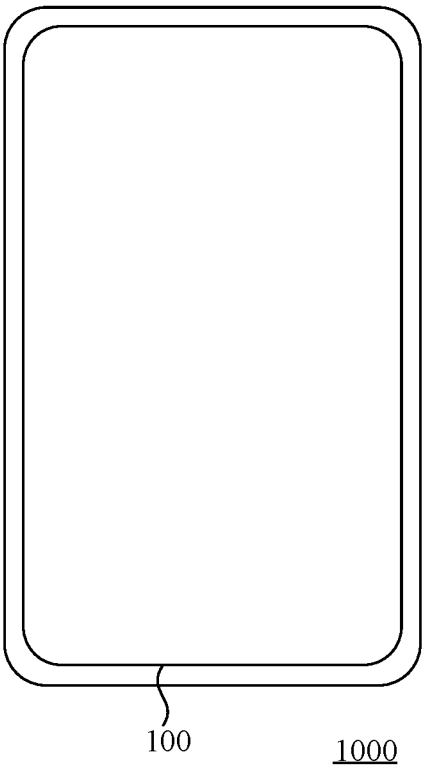
FIG. 24 illustrates a schematic diagram of a display device consistent with various embodiments of the present disclosure.

The present disclosure also provides a display device, including a display panel provided by the present disclosure. Referring to FIG. 24, FIG. 24 illustrates a schematic diagram of a display device consistent with various embodiments of the present disclosure. A display device 1000 provided in FIG. 24 includes the display panel 100 provided in any one of the above embodiments of the present disclosure. One embodiment of FIG. 24 only uses a mobile phone as an example to illustrate the display device 1000. The display device may be a wearable product, a computer, a television, a vehicle-mounted display device, and other display devices with a display function, which is not specifically limited herein. The display device has beneficial effects of the display panel provided in the embodiments of the present disclosure. For details, reference may be made to a specific description of the display panel in the above embodiments, and details are not described herein again.

According to the pixel circuit, the display panel, and the display device provided by the embodiments of the present disclosure, on the one hand, since the leakage suppression module is connected between the driving module and the first reset module, an influence of the leakage current caused by an incomplete turning-off of the first reset module in a light emitting phase on a potential of a control terminal of the driving module can be reduced. On the other hand, by providing the leakage suppression module and the first capacitor, even if the first reset module has a leakage current in the light emitting phase, and the first capacitor is electrically connected to the fixed potential signal terminal, due to a coupling effect of the first capacitor, a potential of the second node can be basically maintained stable in the light emitting phase, so that a cross voltage between the first node and the second node is low, and almost no leakage current flows through the leakage suppression module in the light emitting phase, thereby avoiding affecting a potential of the first node, improving a potential stability of the control terminal of the driving module and improving a display effect.

According to the above embodiments of the present disclosure, the embodiments do not describe all the details in detail, nor do the embodiments limit the present disclosure to only the specific embodiments described. Obviously, many modifications and changes can be made based on the above description. The present specification selects and specifically describes the embodiments in order to better explain principles and practical applications of the present disclosure, so that those skilled in the art can make good use of the present disclosure and make modifications based on the present disclosure. The present disclosure is only limited by the claims and the full scope and equivalents of the claims.

What is claimed is:

1. A pixel circuit, comprising a driving module, a data writing module, a first reset module, a threshold compensation module, light emitting control modules, a leakage suppression module, a storage capacitor, a first capacitor, and a light emitting module, wherein:

the driving module, the light emitting control module, and the light emitting module are connected in series between a first power terminal and a second power terminal, at least one light emitting control module is electrically connected between the driving module and the first power terminal, and at least one light emitting control module is electrically connected between the driving module and the light emitting module;

a first terminal of the data writing module is electrically connected to a data signal terminal, a second terminal of the data writing module is electrically connected to a first terminal of the driving module, a first plate of the storage capacitor is electrically connected to the first power terminal, and a second plate of the storage capacitor is electrically connected to a control terminal of the driving module;

a first terminal of the first reset module is electrically connected to a reference signal terminal, a first terminal of the threshold compensation module is electrically connected to a second terminal of the driving module, a control terminal of the driving module is electrically connected to a first node, a second terminal of the first reset module and a second terminal of the threshold compensation module are both electrically connected to the first node through the leakage suppression module, a connection node between the leakage suppression module and the second terminal of the first reset module is a second node, a first plate of the first capacitor is electrically connected to the second node, and a second plate of the first capacitor is electrically connected to a fixed potential signal terminal; and a first terminal of the leakage suppression module is electrically connected to the fixed potential signal terminal through the second node and the first capacitor, and a second terminal of the leakage suppression module is electrically connected to the first power terminal through the first node and the storage capacitor.

2. The pixel circuit according to claim 1, wherein a control terminal of the first reset module is electrically connected to a first scan signal terminal, a control terminal of the threshold compensation module is electrically connected to a second scan signal terminal, and a control terminal of the leakage suppression module is electrically connected to a third scan signal terminal.

3. The pixel circuit according to claim 2, wherein the leakage suppression module includes a first transistor, a first electrode of the first transistor is electrically connected to the second node, a second electrode of the first transistor is electrically connected to the first node, a gate of the first transistor is electrically connected to the third scanning signal terminal, and the second terminal of the threshold compensation module is electrically connected to the second node.

4. The pixel circuit according to claim 3, wherein the first transistor includes a first sub-transistor and a second sub-transistor, a gate of the first sub-transistor and a gate of the second sub-transistor are electrically connected to the third scan signal terminal, a first electrode of the first sub-transistor is electrically connected to the second node, a second electrode of the first sub-transistor is electrically connected to a first electrode of the second sub-transistor, and a second electrode of the second sub-transistor is electrically connected to the first node.

5. The pixel circuit according to claim 2, wherein the leakage suppression module includes a first transistor, the first transistor includes a first sub-transistor and a second sub-transistor, a gate of the first sub-transistor and a gate of the second sub-transistor are both electrically connected to the third scan signal terminal, a first electrode of the first sub-transistor is electrically connected to the second node, a second electrode of the first sub-transistor is electrically connected to the first node, a first electrode of the second sub-transistor is electrically connected to a third node, a second electrode of the second sub-transistor is electrically connected to the first node, and the second terminal of the threshold compensation module is electrically connected to the third node.

6. The pixel circuit according to claim 5, further comprising a second capacitor, wherein the fixed potential signal terminal includes a first fixed potential signal terminal and a second fixed potential signal terminal, a second plate of the first capacitor is electrically connected to the first fixed potential signal terminal, a first plate of the second capacitor is electrically connected to the third node, and a second plate of the second capacitor is electrically connected to the second fixed potential signal terminal.

7. The pixel circuit according to claim 2, wherein:

the driving module includes a driving transistor, the data writing module includes a second transistor, the threshold compensation module includes a third transistor, and the first reset module includes a fourth transistor, the light emitting control module includes a fifth transistor and a sixth transistor, the light emitting module includes a light emitting diode, and the pixel circuit further includes a seventh transistor;

a gate of the second transistor is electrically connected to the second scan signal terminal, a first electrode of the second transistor is electrically connected to the data signal terminal, a second electrode of the second transistor is electrically connected to a first electrode of the driving transistor;

a gate of the fifth transistor is electrically connected to the light emitting control signal terminal, a first electrode of the fifth transistor is electrically connected to the first power terminal, and a second electrode of the fifth transistor is electrically connected to the first electrode of the driving transistor;

a gate of the sixth transistor is electrically connected to the light emitting control signal terminal, a first electrode of the sixth transistor is electrically connected to a second electrode of the driving transistor, and a second electrode of the sixth transistor is electrically connected to a first electrode of the light emitting diode;

a gate of the seventh transistor is electrically connected to the second scan signal terminal, a first electrode of the seventh transistor is electrically connected to the reference signal terminal, a second electrode of the seventh transistor is electrically connected to the first electrode of the light emitting diode, and a second electrode of the light emitting diode is electrically connected to the second power terminal; and a gate of the third transistor is electrically connected to the second scan signal terminal, a first electrode of the third transistor is electrically connected to the second electrode of the driving transistor, a gate of the fourth transistor is electrically connected to the first scan signal terminal, a first electrode of the fourth transistor is electrically connected to the reference signal terminal, and both a second electrode of the third transistor and a second electrode of the fourth transistor are electrically connected to the first node through the leakage suppression module.

8. The pixel circuit according to claim 1, wherein one of the first power terminal or the reference signal terminal is multiplexed as the fixed potential signal terminal.

9. A display panel, comprising a pixel circuit, the pixel circuit comprising a driving module, a data writing module, a first reset module, a threshold compensation module, light emitting control modules, a leakage suppression module, a storage capacitor, a first capacitor, and a light emitting module, wherein:

the driving module, the light emitting control module, and the light emitting module are connected in series between a first power terminal and a second power terminal, at least one light emitting control module is electrically connected between the driving module and the first power terminal, and at least one light emitting control module is electrically connected between the driving module and the light emitting module;

a first terminal of the data writing module is electrically connected to a data signal terminal, a second terminal of the data writing module is electrically connected to a first terminal of the driving module, a first plate of the storage capacitor is electrically connected to the first power terminal, and a second plate of the storage capacitor is electrically connected to a control terminal of the driving module;

a first terminal of the first reset module is electrically connected to a reference signal terminal, a first terminal of the threshold compensation module is electrically connected to a second terminal of the driving module, a control terminal of the driving module is electrically connected to a first node, a second terminal of the first reset module and a second terminal of the threshold compensation module are both electrically connected to the first node through the leakage suppression module, a connection node between the leakage suppression module and the second terminal of the first reset module is a second node, a first plate of the first capacitor is electrically connected to the second node, and a second plate of the first capacitor is electrically connected to a fixed potential signal terminal; and a first terminal of the leakage suppression module is electrically connected to the fixed potential signal terminal through the second node and the first capacitor, and a second terminal of the leakage suppression module is electrically connected to the first power terminal through the first node and the storage capacitor.

10. The display panel according to claim 9, wherein at least part area of a fixed potential signal line is multiplexed as the second plate of the first capacitor.

11. The display panel according to claim 10, comprising a substrate and a first connection portion, wherein:

the driving module includes a driving transistor, the leakage suppression module includes a first transistor, the data writing module includes a second transistor, the threshold compensation module includes a third transistor, and the first reset module includes a fourth transistor;

a first electrode of the second transistor is connected to a data line, a second electrode of the second transistor is connected to a first electrode of the driving transistor, a first electrode of the third transistor is connected to a second electrode of the driving transistor, a first electrode of the fourth transistor is connected to the reference signal line;

a gate of the fourth transistor is connected to a first scan line, a gate of the third transistor and a gate of the second transistor are both connected to a second scan line, and a gate of the first transistor is connected to a third scan line; and a second electrode of the third transistor, a second electrode of the fourth transistor, and a first electrode of the first transistor are all connected to the first connection portion, a second electrode of the first transistor is electrically connected to a gate of the driving transistor.

12. The display panel according to claim 11, wherein:

the first connection portion is electrically connected to the first plate of the first capacitor; and the fixed potential signal line includes a first body portion and a first branch portion that are connected to each other, an orthographic projection of the first branch portion on the substrate overlaps an orthographic projection of the first electrode plate of the first capacitor on the substrate, and the first branch portion is the second plate of the first capacitor.

13. The display panel according to claim 12, wherein:

the first connection portion includes a metal connection portion and a semiconductor connection portion that are connected to each other, the second electrode of the third transistor is connected to the metal connection portion, and a second electrode of the fourth transistor is connected to the semiconductor connection portion; and an orthographic projection of the metal connection portion on the substrate overlaps an orthographic projection of the third scan line on the substrate, an orthographic projection of the semiconductor connection portion on the substrate is spaced apart from the orthographic projection of the third scan line on the substrate.

14. The display panel according to claim 12, wherein the first connection portion includes a semiconductor portion, the third scan line includes a first segment and a second segment that are connected to each other, the first segment and the second segment are located in different film layers, an orthographic projection of the first segment on the substrate overlaps an orthographic projection of the first connection portion on the substrate, a distance between the orthographic projection of the second segment on the substrate and the orthographic projection of the first connection portion on the substrate, and at least part area of the second segment is multiplexed as the gate of the first transistor.

15. The display panel according to claim 14, wherein the second segment includes a second body portion and a second branch portion that are connected to each other, an extension direction of the second body portion intersects with an extension direction of the second branch portion, and both an orthographic projection of the second body portion on the substrate and the orthographic projection of the second branch portion on the substrate overlap an orthographic projection of the semiconductor portion of the first transistor on the substrate.

16. The display panel according to claim 14, wherein the second branch portion is located on a side of the second body portion away from the driving transistor.

17. The display panel according to claim 12, wherein the first power line is multiplexed as the fixed potential signal line, the first plate of the first capacitor and the reference signal line are located on a same film layer, and the first branch portion and the first body portion on a same film layer.

18. The display panel according to claim 17, wherein the first branch portion extends in a first direction, the first body portion extends in a second direction, the first direction crosses the second direction, the display panel further includes a second connection portion extending along the first direction, and the second connection portion is connected between adjacent first branch portions in the first direction.

19. The display panel according to claim 11, wherein the orthographic projection of the first connection portion on the substrate overlaps an orthographic projection of the reference signal line on the substrate, the first connection portion is multiplexed as the first plate of the first capacitor, and the reference signal line is multiplexed as the fixed potential signal line.

20. The display panel according to claim 10, further comprising a substrate, a third connection portion and a fourth connection portion, wherein:

the driving module includes a driving transistor, the leakage suppression module includes a first transistor, the first transistor includes a first sub-transistor and a second sub-transistor, the data writing module includes a second transistor, and the threshold compensation module includes a third transistor, and the first reset module includes a fourth transistor;

a first electrode of the second transistor is connected to a data line, a second electrode of the second transistor is connected to a first electrode of the driving transistor, and a first electrode of the third transistor is connected to a second electrode of the driving transistor, a first electrode of the fourth transistor is connected to the reference signal line;

a gate of the fourth transistor is connected to a first scan line, a gate of the third transistor and a gate of the second transistor are both connected to a second scan line, and a gate of the first transistor is connected to a third scan line;

a second electrode of the fourth transistor is electrically connected to a first electrode of the first sub-transistor through the third connection portion, a second electrode of the third transistor is electrically connected to a first electrode of the second sub-transistor through the fourth connection portion, a second electrode of the first sub-transistor and a second electrode of the second sub-transistor are electrically connected to a gate of the driving transistor; and the fixed potential signal line includes a first fixed potential signal line and a second fixed potential signal line, an orthographic projection of the first fixed potential signal line on the substrate overlaps an orthographic projection of the third connection portion on the substrate, an orthographic projection of the second fixed potential signal line on the substrate overlaps an orthographic projection of the fourth connection portion on the substrate.

21. The display panel according to claim 20, wherein the reference signal line is multiplexed as the first fixed potential signal line, and the first power line is multiplexed as the second fixed potential signal line.

22. A display device, comprising a display panel, the display panel comprising a pixel circuit, the pixel circuit comprising a driving module, a data writing module, a first reset module, a threshold compensation module, light emitting control modules, a leakage suppression module, a storage capacitor, a first capacitor, and a light emitting module, wherein:

the driving module, the light emitting control module, and the light emitting module are connected in series between a first power terminal and a second power terminal, at least one light emitting control module is electrically connected between the driving module and the first power terminal, and at least one light emitting control module is electrically connected between the driving module and the light emitting module;

a first terminal of the data writing module is electrically connected to a data signal terminal, a second terminal of the data writing module is electrically connected to a first terminal of the driving module, a first plate of the storage capacitor is electrically connected to the first power terminal, and a second plate of the storage capacitor is electrically connected to a control terminal of the driving module;

a first terminal of the first reset module is electrically connected to a reference signal terminal, a first terminal of the threshold compensation module is electrically connected to a second terminal of the driving module, a control terminal of the driving module is electrically connected to a first node, a second terminal of the first reset module and a second terminal of the threshold compensation module are both electrically connected to the first node through the leakage suppression module, a connection node between the leakage suppression module and the second terminal of the first reset module is a second node, a first plate of the first capacitor is electrically connected to the second node, and a second plate of the first capacitor is electrically connected to a fixed potential signal terminal; and a first terminal of the leakage suppression module is electrically connected to the fixed potential signal terminal through the second node and the first capacitor, and a second terminal of the leakage suppression module is electrically connected to the first power terminal through the first node and the storage capacitor.

* * * * *